US011118298B2

(12) United States Patent
Nakagawa et al.

(10) Patent No.: US 11,118,298 B2
(45) Date of Patent: Sep. 14, 2021

(54) WASHING MACHINE

(71) Applicant: SAMSUNG ELECTRONICS CO., LTD., Suwon-si (KR)

(72) Inventors: Yukinori Nakagawa, Yokohama (JP); Tomonori Ueno, Yokohama (JP); Hiroshi Katsumoto, Yokohama (JP); Kenji Kitajima, Yokohama (JP); Yasuyuki Sonoda, Yokohama (JP); Masaki Oshige, Yokohama (JP); Hidekazu Funakoshi, Yokohama (JP); Yasumasa Nagasaki, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 341 days.

(21) Appl. No.: 15/655,234

(22) Filed: Jul. 20, 2017

(65) Prior Publication Data

US 2018/0030638 A1 Feb. 1, 2018

(30) Foreign Application Priority Data

Jul. 28, 2016 (JP) ..... JP2016-148896
Jul. 28, 2016 (JP) ..... JP2016-148897
(Continued)

(51) Int. Cl.

| | |
|---|---|
| ***D06F 37/30*** | (2020.01) |
| ***D06F 37/20*** | (2006.01) |
| ***D06F 37/40*** | (2006.01) |
| *D06F 37/26* | (2006.01) |

(52) U.S. Cl.
CPC ..... *D06F 37/20* (2013.01); *D06F 37/206* (2013.01); *D06F 37/40* (2013.01); *D06F 37/26* (2013.01)

(58) Field of Classification Search
CPC ..... D06F 37/206; D06F 37/30; D06F 37/304; D06F 37/306; D06F 37/36; D06F 37/38;
(Continued)

(56) References Cited

U.S. PATENT DOCUMENTS 4,959,596 A * 9/1990 MacMinn ..... D06F 37/304 318/254.2
2001/0008354 A1 7/2001 Minagawa
(Continued)

FOREIGN PATENT DOCUMENTS

JP 3719136 B2 11/2005
KR 10-2006-0020266 3/2006
(Continued)

OTHER PUBLICATIONS

International Search Report dated Sep. 22, 2017 in International Patent Application PCT/KR2017/007403.
(Continued)

*Primary Examiner* — David G Cormier
(74) *Attorney, Agent, or Firm* — Staas & Halsey LLP

(57) ABSTRACT

A washing machine capable of independently driving two rotors using one inverter in a simple configuration without supplying a composite current includes an outer rotor having a plurality of switching magnets arranged at intervals in the circumferential direction, and an inner rotor having a plurality of stationary magnets arranged to be radially arranged at intervals in the circumferential direction. When a magnetizing current is supplied to the coil of the stator, the magnetic pole of the switching magnet is inverted and the number of the poles of the outer rotor is switched.

20 Claims, 36 Drawing Sheets

(30) Foreign Application Priority Data

| | | |
|---|---|---|
| Jul. 28, 2016 | (JP) | JP2016-148898 |
| Jul. 28, 2016 | (JP) | JP2016-148899 |
| Jul. 29, 2016 | (JP) | JP2016-149871 |
| Aug. 19, 2016 | (JP) | JP2016-161073 |
| Apr. 28, 2017 | (KR) | 10-2017-0055769 |

(58) Field of Classification Search
CPC ..... D06F 37/40; H02K 16/02; H02K 19/103; H02K 19/106; H02K 19/12
See application file for complete search history.

(56) References Cited

U.S. PATENT DOCUMENTS

| | | | | |
|---|---|---|---|---|
| 2004/0232800 | A1 | 11/2004 | Seguchi | |
| 2006/0042022 | A1* | 3/2006 | Kim | D06F 37/304 8/159 |
| 2013/0160499 | A1* | 6/2013 | Kim | A47L 15/0018 68/12.16 |

FOREIGN PATENT DOCUMENTS

| | | |
|---|---|---|
| KR | 10-2011-0139433 | 12/2011 |
| KR | 10-2016-0075614 | 6/2016 |
| WO | 2013/100440 | 7/2013 |
| WO | WO 2015/050397 A1 | 4/2015 |

OTHER PUBLICATIONS

European Search Report dated May 23, 2019 in corresponding European Patent Application No. 17834670.6.

Korean Office Action for Korean Patent Application No. 10-2017-0055769 dated Jun. 12, 2021.

* cited by examiner

WASHING MACHINE

CROSS-REFERENCE TO RELATED APPLICATION

This application claims the priority benefit of Japan Patent Application Nos. 2016-148896 filed on Jul. 28, 2016, 2016-148897 filed on Jul. 28, 2016, 2016-148898 filed on Jul. 28, 2016, 2016-148899 filed on Jul. 28, 2016, 2016-149871 filed on July 29, 2016, and 2016-161173 filed on Aug. 19, 2016, in the Japan Patent Office and Korean Patent Application No. 10-2017-0055769, filed on Apr. 28, 2017, in the Korean Intellectual Property Office. The disclosures of each of the above-identified applications are incorporated herein by reference in their entirety.

BACKGROUND

1. Field

The disclosure relates to a washing machine including a motor.

2. Description of the Related Art

In general, there has been known a rotating electric device in which two rotors and one stator are formed on the same shaft in a three-layer structure and simultaneously a common coil that generates separate rotating magnetic fields with respect to the two rotors is formed on the stator (for example, see Japanese Patent Publication No. 3480300).

In Japanese Patent Publication No. 3480300, each of the rotors is independently driven by applying a composite current formed by adding corresponding currents applied to the rotors, to a common coil formed on a stator.

However, in the related art, since a size of an inverter for applying a composite current is large, a configuration thereof becomes complicated and cost is high. Also, since torque balance is used to prevent a current of one side of the composite current from having an effect on torque of another side, efficiency is low.

To overcome the above-described limitation, it is an aspect of the disclosure to provide a washing machine capable of independently driving two rotors using one inverter in a simple configuration without supplying a composite current.

Additional aspects of the disclosure will be set forth in part in the description which follows and, in part, will be apparent from the description, or may be learned by practice of the disclosure.

SUMMARY

In accordance with an aspect of the disclosure, a washing machine includes: a washing tub configured to accommodate water, a spin-drying tub rotatably installed in the washing tub and configured to accommodate laundry, a pulsator rotatably installed in the spin-drying tub and configured to stir the laundry, and a motor configured to rotate the spin-drying tub and the pulsator, wherein the motor includes an annular stator and a first rotor and a second rotor rotatable independently from the stator, wherein one of the first rotor and the second rotor is connected to the spin-drying tub, and wherein the other of the first rotor and the second rotor is connected to the pulsator.

The washing machine may further include a controller configured to drive the first rotor and the second rotor in a plurality of rotation modes, wherein the controller is formed of one inverter and drives the first rotor and the second rotor in the plurality of rotation modes by reversing magnetic poles of at least one of the first rotor and the second rotor.

The washing machine may further include a magnetic pole number converter configured to convert a magnetic pole number by reversing magnetic poles of at least one of the first rotor and the second rotor, wherein the controller drives the first rotor and the second rotor in the plurality of rotation modes by controlling a conversion operation of the magnetic pole number converter.

The one of the first rotor and the second rotor includes a plurality of convertible magnets with magnetic poles reversed based on the conversion operation of the magnetic pole number converter, and the other of the first rotor and the second rotor includes a plurality of fixed magnets with magnetic poles not reversed based on the conversion operation of the magnetic pole number converter.

The controller controls the conversion operation of the magnetic pole number converter to reverse some and all magnetic poles of the plurality of convertible magnets.

The controller controls the conversion operation of the magnetic pole number converter to magnetize all of the plurality of convertible magnets with a random magnetic flux amount.

The magnetic pole number converter has a common magnetic path with respect to the first rotor and the second rotor and converts a magnetic pole number by reversing magnetic poles of at least one of the first rotor and the second rotor when magnetization currents are applied to a coil wound on the magnetic path.

The magnetic pole number converter is teeth of the stator, and wherein among the teeth magnetized when magnetization currents are supplied to coils wound on the teeth, magnetic resistance that passes through magnets of the rotor including a convertible magnets is greater than magnetic resistance near an air gap which does not pass through magnets of the rotor opposite to the rotor including the convertible magnets.

The magnetic pole number converter is teeth of the stator, and wherein among the teeth magnetized when magnetization currents are supplied to coils wound on the teeth, magnetic resistance that passes through magnets of the rotor opposite to the rotor including a convertible magnets is greater than magnetic resistance near an air gap which does not pass through the magnets of the rotor opposite to the rotor including the convertible magnets.

The first rotor is an inner rotor disposed inside in a diametrical direction of the stator, and the second rotor is disposed outside in the diameter direction of the stator.

The outer rotor includes a plurality of convertible magnets with magnetic poles converted based on the conversion operation of the magnetic pole number converter, and the inner rotor includes a plurality of fixed magnets not converted based on the conversion operation of the magnetic pole number converter.

The plurality of rotation modes comprise a first rotation mode of driving the first rotor and the second rotor in opposite directions and a second rotation mode of driving the first rotor and the second rotor in the same direction.

The controller drives the spin-drying tub and the pulsator in the first rotation mode during a washing operation.

The controller drives the spin-drying tub and the pulsator in the second rotation mode during a spin-drying operation.

The controller drives the first rotor and the second rotor in two rotation modes having different rotation numbers.

The controller drives the first rotor and the second rotor in the second rotation mode during a high speed rotation mode in which rotation numbers of the first rotor and the second rotor are greater than a certain rotation number.

The first rotor and the second rotor are formed of two or more types of magnets having different coercive forces.

The stator includes a plurality of teeth arranged at intervals in a circumferential direction and extended along a diametrical direction.

In accordance with another aspect of the disclosure, a washing machine includes: a washing tub, a spin-drying tub rotatably installed in the washing tub, a pulsator rotatably installed in the spin-drying tub, and a motor configured to rotate the spin-drying tub and the pulsator, the motor includes: a stator, an inner rotor, disposed inside of the stator with respect to a radial direction of the stator, connected to the spin-drying tub and rotatable independently from the stator, and configured to be driven in a plurality of rotation modes, and an outer rotor, disposed outside of the stator with respect to the radial direction of the stator, connected to the pulsator and rotatable independently from the stator, and configured to be driven in the plurality of rotation modes.

The washing machine may further include an inverter, connected to the motor, configured to apply a magnetization current to at least one coil provided on the stator to control a rotation mode among the plurality of rotation modes by changing a magnetic pole number of the outer rotor.

The inner rotor includes a plurality of fixed inner magnets having polarities which are not changeable according to a magnetized current applied to a coil provided on the stator, and the outer rotor includes a plurality of outer magnets including at least one convertible outer magnet, the at least one convertible outer magnet having a polarity which is changeable according to the magnetized current applied to the coil provided on the stator.

The plurality of outer magnets include a plurality of convertible outer magnets and at least one fixed outer magnet, at least two of the plurality of convertible outer magnets are arranged adjacent to one another, and the at least one fixed outer magnet has a polarity which is not changeable according to the magnetized current applied to the coil provided on the stator.

In accordance with another aspect of the disclosure, a washing machine includes: a washing tub, a spin-drying tub rotatably installed in the washing tub, a pulsator rotatably installed in the spin-drying tub, and a motor configured to rotate the spin-drying tub and the pulsator, the motor includes: a stator having at least one tee with at least one coil wound on the at least one tee, an inner rotor, disposed inside of the stator with respect to a radial direction of the stator, rotatable independently from the stator, and an outer rotor, disposed outside of the stator with respect to the radial direction of the stator, rotatable independently from the stator, the outer rotor including a plurality of convertible magnets that change polarity according to a magnetization current applied to the at least one coil, and a controller configured to apply the magnetization current to the at least one coil to control a rotation mode among a plurality of rotation modes of the inner rotor and the outer rotor by changing a magnetic pole number of the outer rotor.

BRIEF DESCRIPTION OF THE DRAWINGS

These and/or other aspects of the disclosure will become apparent and more readily appreciated from the following description of the embodiments, taken in conjunction with the accompanying drawings of which:

FIGS. 10A, 10B, 100, 10D, 10E and 10F are views illustrating rotation modes when a magnetic pole number of the outer rotor is 32.

DETAILED DESCRIPTION

Figure 1:
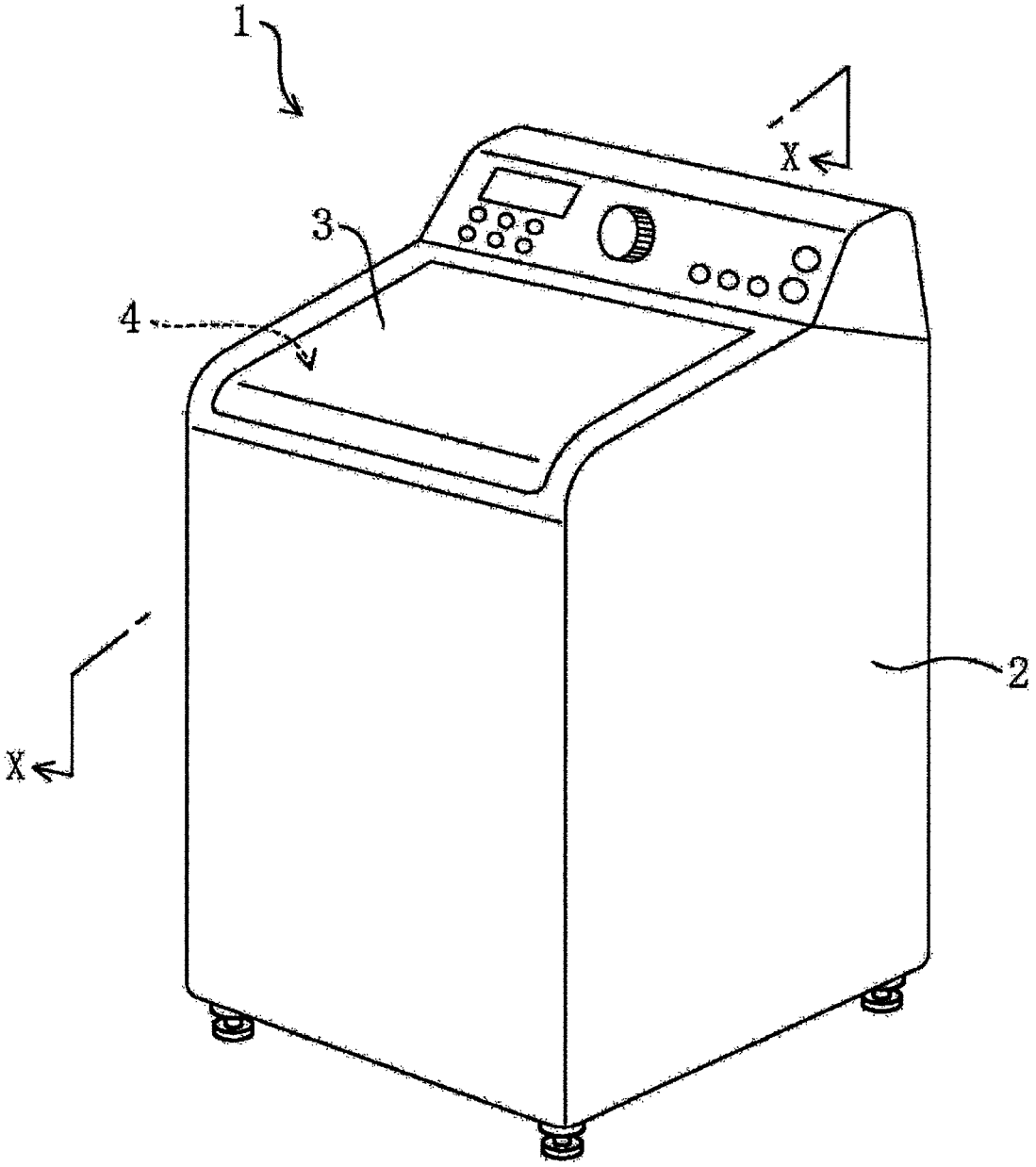
FIG. 1 is a schematic perspective view of a washing machine according to a first embodiment of the disclosure.

Embodiments disclosed in the disclosure and components shown in the drawings are merely preferable examples and various modifications capable of replacing the embodiments and drawings of the disclosure may be made at the time of filing the application.

Also, the terms used herein are to explain the embodiments but are not intended to limit and/or define the disclosure. Singular forms, unless contextually otherwise defined, include plural forms. Throughout the disclosure, the terms "comprise", "include", "have" or the like are used herein to specify the presence of stated features, numbers, steps, operations, elements, components or combinations thereof but do not preclude the presence or addition of one or more other features, numbers, steps, operations, elements, components, or combinations thereof.

Also, even though the terms including ordinals such as first, second and the like may be used for describing various components, the components will not be limited by the terms and the terms are used only for distinguishing one component from others. For example, without departing from the scope of the disclosure, a first component may be referred to as a second component, and similarly, the second component may be referred to as the first component. The term "and/or" includes any and all combinations or one of a plurality of associated listed items.

A configuration of a washing machine will be discussed with respect to an embodiment of the disclosure. FIG. 1 is a schematic perspective view of a washing machine according to a first embodiment of the disclosure, and FIG. 2 is a schematic cross-sectional view illustrating a part taken along line X-X of FIG. 1.

In FIG. 1, a washing machine 1 according to the first embodiment of the disclosure is a fully automatic washing machine capable of performing each operation of washing, rinsing, and spin-drying through automatic control. The washing machine 1 includes a case 2 having a lengthwise rectangular box shape and an inlet 4 formed thereabove and opened and closed by a cover 3. Withdrawing and inserting of laundry is performed through the inlet 4 (a so-called a longitudinal washing machine having a vertical shaft). Various switches or a display operated by a user is installed behind the inlet 4.

Figure 2:
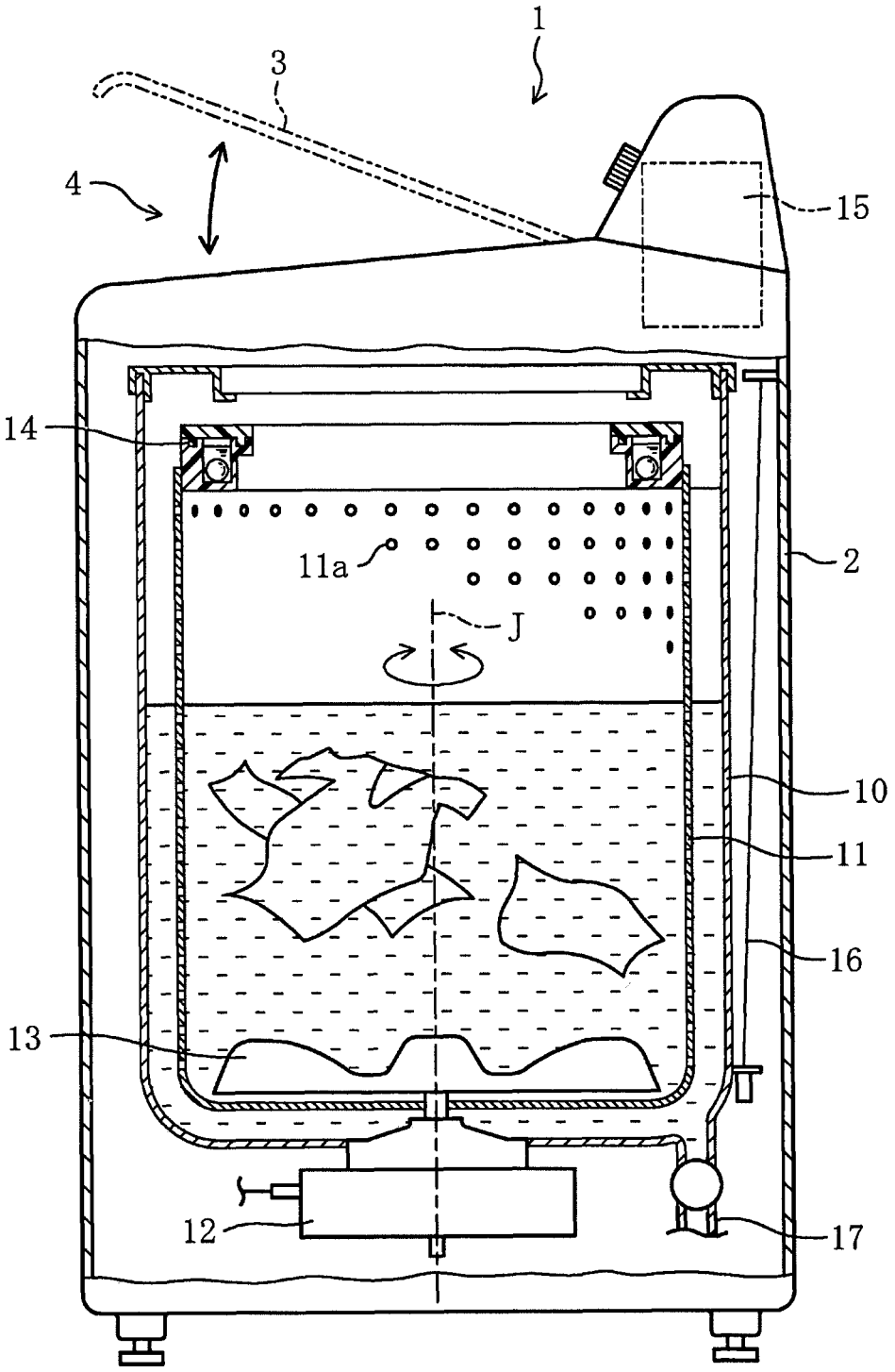
FIG. 2 is a schematic cross-sectional view illustrating a part taken along line X-X of FIG. 1.

In FIG. 2, a washing tub 10, a spin-drying tub 11, a motor 12, a pulsator 13, a balancer 14, a controller 15 and the like are installed in the case 2. Particularly, since the washing machine 1 includes the motor 12 having a compact size and capable of performing adequate performance for each operation of the washing machine, the motor 12 will be separately described below in detail.

The washing tub 10 is a cylindrical container including a water-storable bottom and is suspended in the case 2 by a plurality suspending members 16 while an opening faces the inlet 4 thereabove. To an inside of the washing tub 10, water is supplied through a water inlet device (not shown). A drainpipe 17 controlled by a valve to be opened and closed is connected to a lower part of the washing tub 10, and unnecessary water is discharged outside the washing machine 1 through the drainpipe 17.

The spin-drying tub 11 is a cylindrical container that has a size smaller than the washing tub 10 and includes a bottom that accommodates laundry. The spin-drying tub 11 includes an opening that faces the inlet 4 and is accommodated in the washing tub 10 while being rotatable around a longitudinal shaft J extended in a perpendicular direction. All of laundry processing is performed in the above-described spin-drying tub 11. A plurality of drainage holes 11*a* (partially shown in the drawing) are formed throughout the entire surface of a cylindrical perimeter wall of the spin-drying tub 11. The balancer 14 is installed at the opening of the spin-drying tub 11.

The balancer 14 is a ring-shaped member in which a plurality of balls or a viscous fluid is accommodated. The balancer 14 adjusts an imbalance of weight generated by deviation of laundry while the spin-drying tub 11 rotates.

The pulsator 13 having a circular plate shape with stirring blades on a top surface is rotatably installed at a low part of the spin-drying tub 11.

The controller 15 includes hardware such as a central processing unit (CPU), a read-only memory (ROM) or the like and software such as a control program and the like and controls each operation performed by the washing machine 1. The controller 15 is electrically connected to various switches, the motor 12 and the like, and the control program executes washing, rinsing, and spin-drying operations according to an instruction of the user. For example, in the washing or rinsing operation, the motor 12 rotates while reversing the pulsator 13 on a certain cycle, to stir laundry with water or a detergent. In the spin-drying operation, the motor 12 rotates the spin-drying tub 11 in a certain direction at high speed to pressurize laundry toward a peripheral wall to spin-dry using a centrifugal effect.

The motor 12 has an exterior in a flat cylindrical shape with a diameter smaller than that of the washing tub 10 and is attached to the lower part of the washing tub 10 to allow a longitudinal shaft to pass therethrough.

Figure 3:
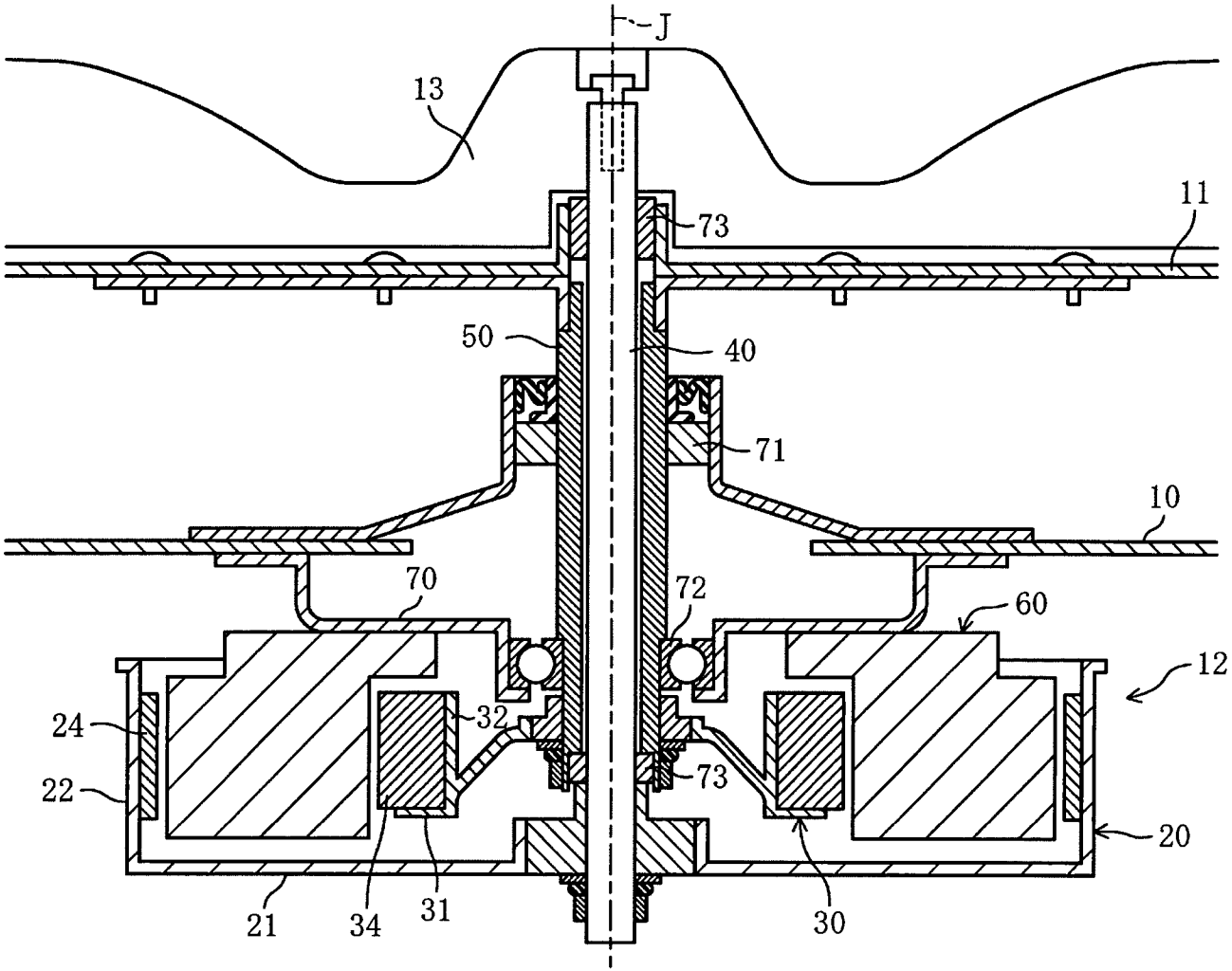
FIG. 3 is a schematic longitudinal cross-sectional view illustrating an assembling structure of the motor according to the first embodiment of the disclosure.
Figure 4:
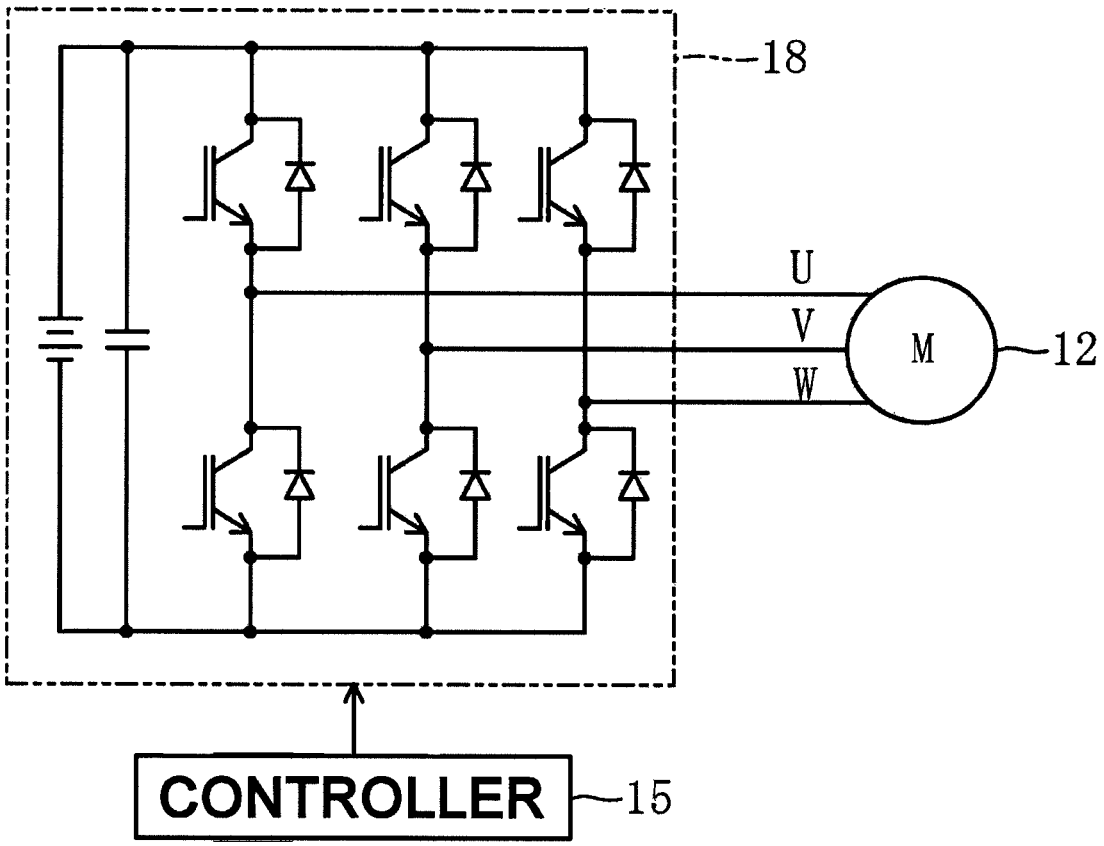
FIG. 4 is a circuit diagram illustrating a configuration of an inverter according to the first embodiment of the disclosure.
Figure 5:
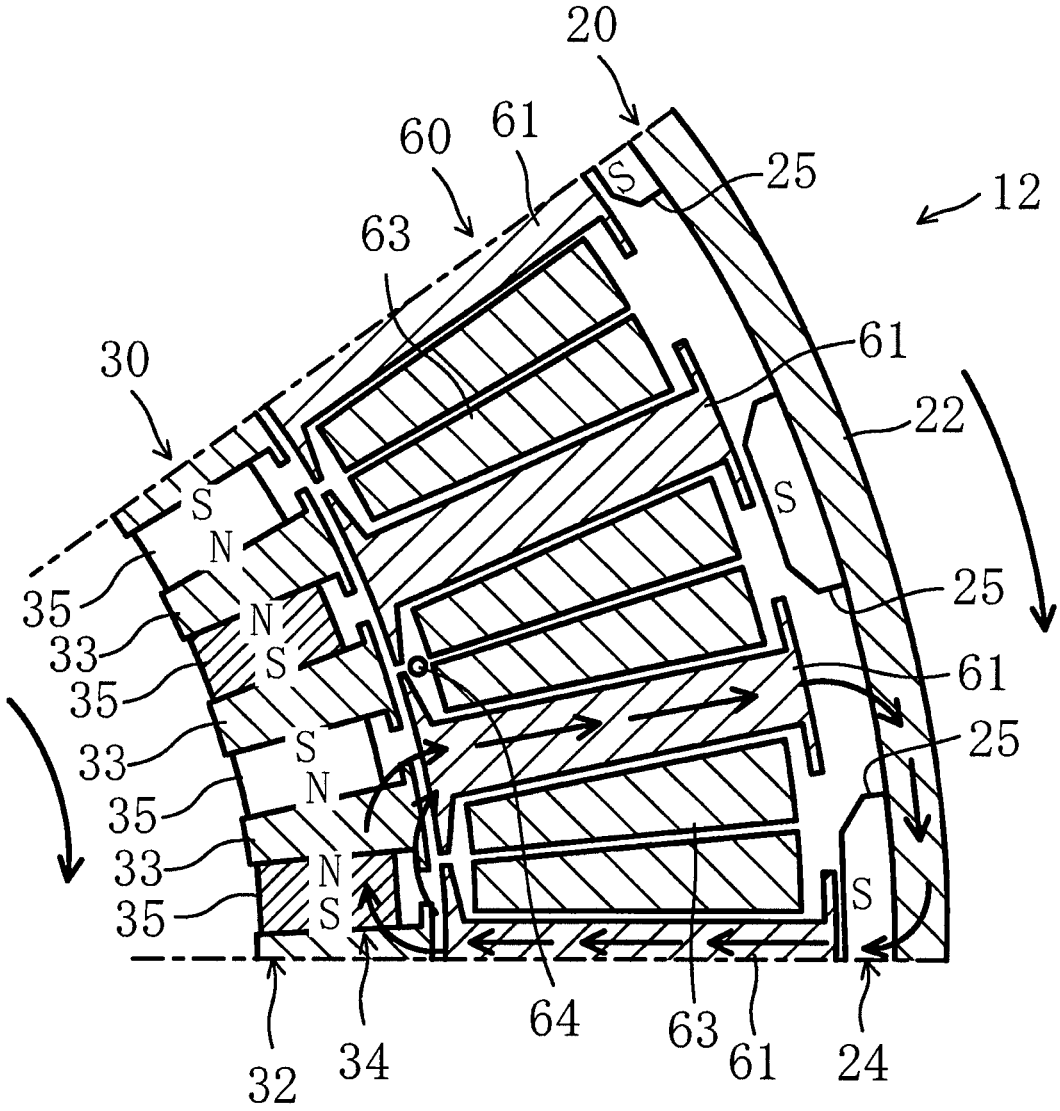
FIG. 5 is a top cross-sectional view illustrating a configuration of the motor according to the first embodiment of the disclosure and illustrates that the number of magnetic poles of an outer rotor is 32.
Figure 6:
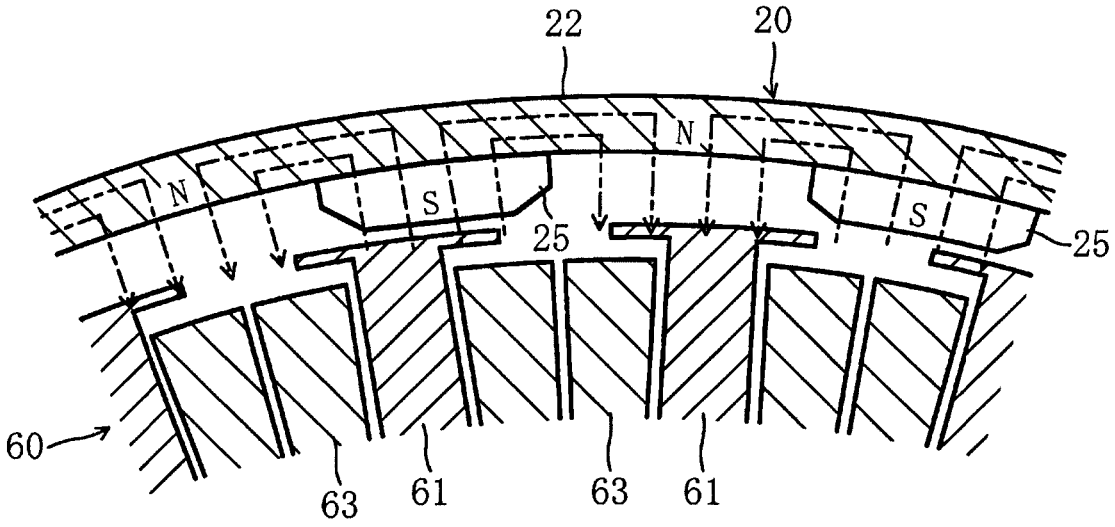
FIG. 6 is a top cross-sectional view illustrating a movement path of magnetic flux in FIG. 5.
Figure 7:
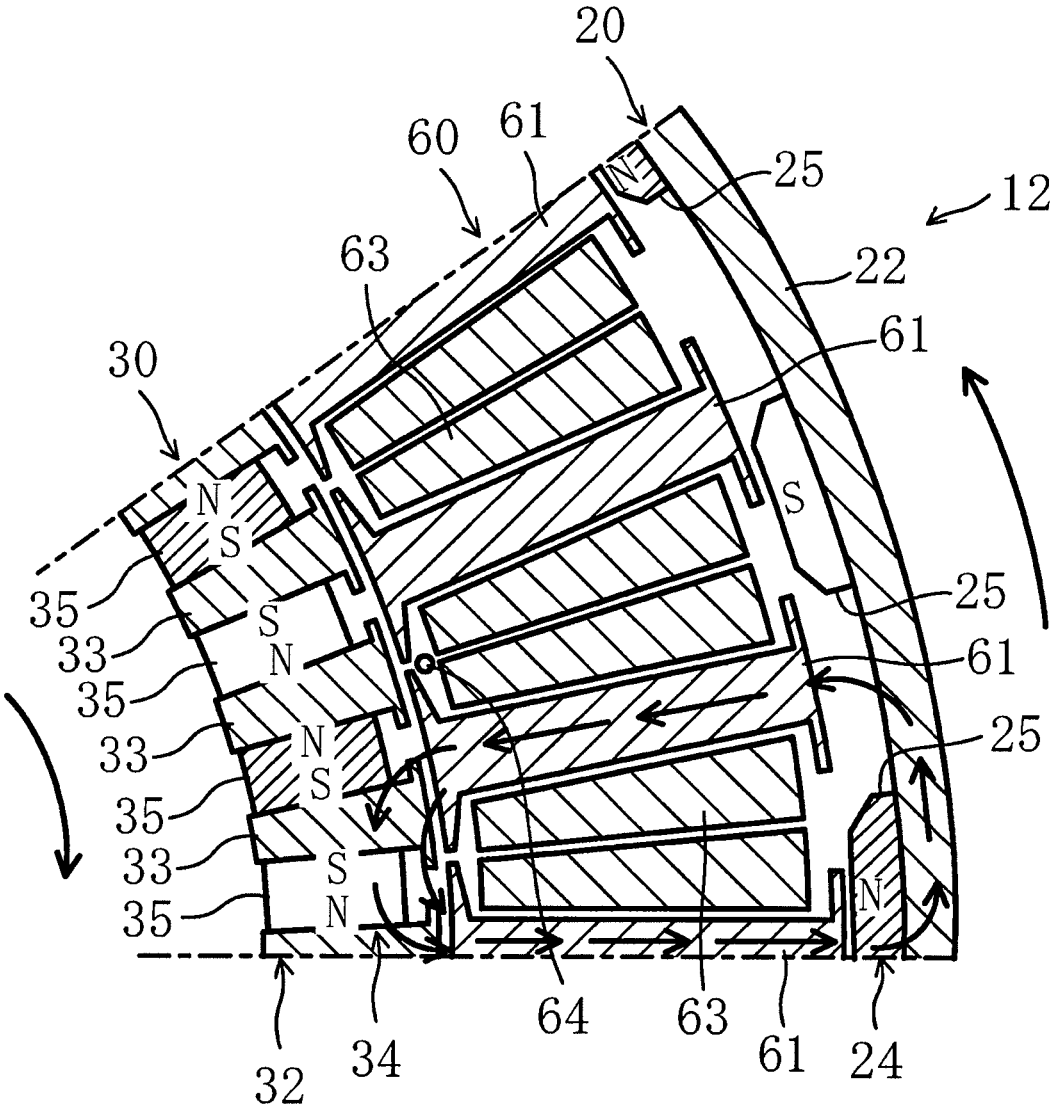
FIG. 7 is a top cross-sectional view illustrating the configuration of the motor according to the first embodiment of the disclosure and illustrates that the number of magnetic poles of an outer rotor is 16.
Figure 8:
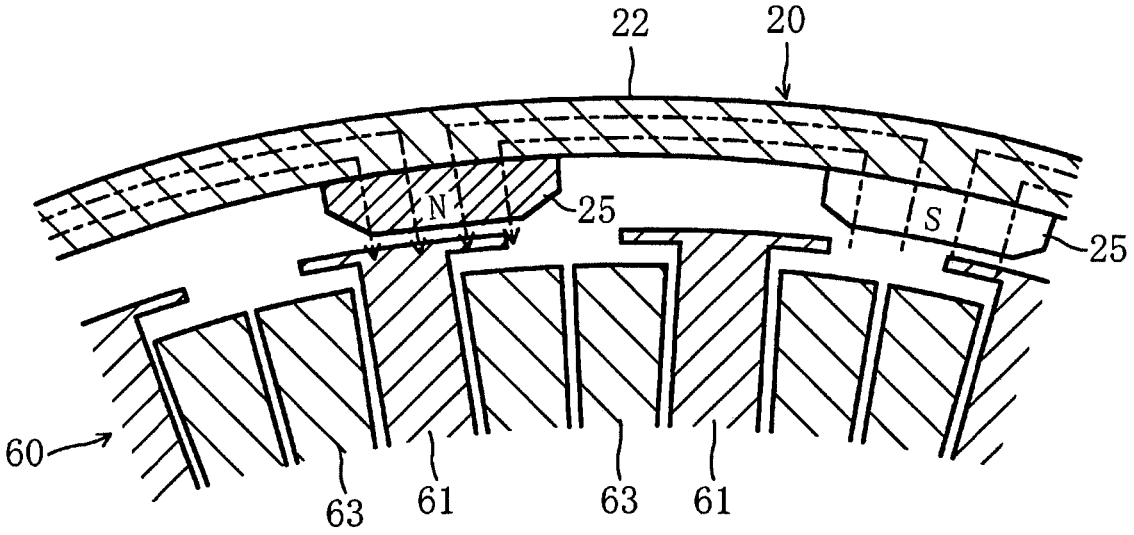
FIG. 8 is a top cross-sectional view illustrating a movement path of magnetic flux in FIG. 7.

FIG. 3 is a schematic longitudinal cross-sectional view illustrating an assembling structure of the motor according to the first embodiment of the disclosure. FIG. 4 is a circuit diagram illustrating a configuration of an inverter according to the first embodiment of the disclosure. FIG. 5 is a top cross-sectional view illustrating a configuration of the motor according to the first embodiment of the disclosure and illustrates that the number of magnetic poles of an outer rotor is 32. FIG. 6 is a top cross-sectional view illustrating a movement path of magnetic flux in FIG. 5. FIG. 7 is a top cross-sectional view illustrating the configuration of the motor according to the first embodiment of the disclosure and illustrates that the number of magnetic poles of an outer rotor is 16. FIG. 8 is a top cross-sectional view illustrating a movement path of magnetic flux in FIG. 7.

In FIG. 3, the motor 12 includes an outer rotor 20, that is, a second rotor, an inner rotor 30, that is, a first rotor, an inner shaft 40, an outer shaft 50, a stator 60 and the like. That is, the motor 12 is a so-called dual rotor motor including the outer rotor 20 and the inner rotor 30 on the outside and inside of one stator 60 in a diametrical direction. Also, the outer rotor 20 and the inner rotor 30 are connected to the pulsator 13 or the spin-drying tub 11 without interposing a clutch, an accelerator/decelerator or the like, to directly drive them.

Since the outer rotor 20 and the inner rotor 30 commonly use a coil 63 of the stator 60, the motor 12 is configured to independently rotate each of the outer rotor 20 and the inner rotor 30 by supplying a current to the coil 63. The stator 60 is installed at a bearing bracket 70 installed on a bottom surface of the washing tub 10.

The outer rotor 20 is a member having a cylindrical shape with a flat bottom and includes a bottom wall 21 with an open center, a rotor yoke 22 installed on a circumference of the bottom wall 21, and a plurality of outer magnets 24 including permanent magnets in a circular arc shape. The bottom wall 21 and the rotor yoke 22 are formed by pressing a steel plate to function as a back yoke.

In the first embodiment of the disclosure, the outer rotor 20 is a consequent rotor in which sixteen outer magnets 24 are arranged to align south poles at intervals in a circumferential direction and are fixed to an inner surface of the rotor yoke 22. Also, although described below in detail, the number of magnetic poles of the outer rotor 20 may be converted between sixteen poles and thirty two poles by reversing magnetic poles of the outer magnets 24.

The inner rotor 30 is a cylindrical member including a flat bottom with an outer diameter smaller than that of the outer rotor 20 and includes an inner bottom wall 31 with an open center, an inner peripheral wall 32 erected and installed around the inner bottom wall 31, and a plurality of inner magnets 34 including permanent magnets having a rectangular plate shape.

In the first embodiment of the disclosure, the inner rotor 30 is a spoke type rotor in which thirty two inner magnets 34 are arranged at intervals in a radial shape in a circumferential direction and are installed and fixed to the inner peripheral wall 32. A rotor core 33 is disposed between the inner magnets 34 in the circumferential direction.

The inner shaft 40 is a cylindrical shaft member and is rotatably supported by the bearing bracket 70 through an inner bearing 73, the outer shaft 50, and ball bearings 71 and 72. A bottom end of the inner shaft 40 is connected to the outer rotor 20. A top end of the inner shaft 40 is connected to the pulsator 13.

The outer shaft 50 is a cylindrical shaft member shorter than the inner shaft 40 and having an outer diameter greater than that of the inner shaft 40 and is rotatably supported by the bearing bracket 70 through upper and lower inner bearings 73, the inner shaft 40, and the ball bearings 71 and 72. A bottom end of the outer shaft 50 is connected to the inner rotor 30. A top end of the outer shaft 50 is connected to the spin-drying tub 11.

The stator 60 has an outer diameter smaller than an inner diameter of the outer rotor 20 and is formed as an annular shape with an inner diameter larger than the outer diameter of the inner rotor 30. The stator 60, as shown in FIG. 5, is provided while a plurality of teeth 61, coils 63, and the like are embedded in a resin. The stator 60 according the embodiment includes twenty four I-shaped teeth 61 and the coils 63.

The teeth 61 are steel members having a thin plate shape with an I-shaped longitudinal cross-section and are arranged around the entire stator 60 in a radial shape at equidistant intervals. Side ends of an inner circumference and an outer circumference of the tee 61 protrude from both corners thereof, in a shade shape in a circumferential direction.

Here, between adjacent teeth 61, a slot opening of the outer rotor 20 is larger than a slot opening of the inner rotor 30. As the slot opening of the outer rotor 20 having a convertible magnet 25 is large, it becomes easy to convert a magnetic pole.

The coil 63 is formed on each of the teeth 61 by interposing an insulator between the teeth 61 and winding three wires coated with insulators in a certain order and configuration. A group of the teeth 61 on which the coils 63 are formed are embedded in a thermosetting resin by molding while only cross sections of diameters are exposed, and are fixed in a certain arrangement while being insulated.

The stator 60, the inner rotor 30, and the outer rotor 20 are attached in such a way that ends of the teeth 61 at the inner rotor 30 face the rotor cores 33 with a slight gap, and ends of the teeth 61 at the outer rotor 20 face the outer magnets 24 with a slight gap.

A position sensor 64 is disposed between adjacent teeth 61. The position sensor 64 is disposed at a position near the inner rotor 30 to recognize a position of the inner rotor 30.

In FIG. 4, a three phase inverter 18 is connected to the motor 12. In the motor 12, when currents are applied to the coils 63 of the stator 60, different poles are generated at outer sides and inner sides of the teeth 61 at the same time and the outer rotor 20 and the inner rotor 30 independently rotate accompanying a rotor system.

As described above, since the stator 60 is commonly used by the outer rotor 20 and the inner rotor 30, the outer rotor 20 and the inner rotor 30 may be rotated in a plurality of rotation modes by one inverter 18.

An operation of converting the number of magnetic poles will be discussed with reference to the drawings. FIG. 5 is a top cross-sectional view illustrating a major portion of the motor 12 and illustrates a state of a mechanical angle of 45°. All of the outer magnets 24 are formed of the convertible magnets 25. All of the inner magnets 34 are formed of fixed magnets 35.

The convertible magnets 25 are magnets with polarity that is converted when magnetized currents are supplied to the coils 63 as magnetic pole number converters. The fixed magnets 35 are magnets with polarity that is not reversed even when magnetized currents are supplied to the coils 63. It is unnecessary to depend on the magnitude, type or the like of coercive force.

Here, reversing or nonreversing indicates polarities of the whole magnets and it is determined using total magnetic flux even when there are some opposite poles.

In the first embodiment of the disclosure, it is configured that a magnetic pole number St of the stator 60 is 24, a magnetic pole number of the inner rotor 30 is 32, and a maximum magnetic pole number of the outer rotor 20 is 32 and a ratio thereamong is St:m=3:4. Here, the outer rotor 20 is converted in magnetic pole number through magnetization to be convertible into 32 or 16 poles.

In a state shown in FIG. 5, the outer magnets 24 are arranged at intervals in the circumferential direction and to allow surfaces of the outer magnets 24 at the teeth 61 to be S poles. Since the outer magnets 24 are arranged as described above, the rotor yoke 22 of the outer rotor 20 between the outer magnets 24 having S poles becomes N pole and the magnetic pole number of the outer rotor 20 becomes 32. Here, since a salient pole structure is not provided at the N pole of the rotor yoke 22, magnetic resistances between the rotor yoke 22 and the teeth 61 become approximately identical. It is possible to provide a configuration with vibration or noise suppressed using the above-described consequent rotor without a salient structure.

As shown in FIG. 6, magnetic flux out of the N pole of the rotor yoke 22 passes through the inner rotor 30 through the tee 61, enters the S pole of the outer magnet 24 through another tee 61, passes through the rotor yoke 22, and returns to the N pole of the rotor yoke 22.

Here, since an air gap that is a gap between the rotor yoke 22 of the N pole and the tee 61 is large when the magnetic pole number of the outer rotor 20 is 32, induced voltage is decreased. Due thereto, it is necessary to allow the magnetic pole number of the outer rotor 20 to be 32 in spin-drying that requires high speed or low torque.

Meanwhile, when some magnetic poles of the outer magnets 24 are reversed by supplying magnetization currents to the coil 63 and converted to alternately arrange N poles and S poles in the circumferential direction, the magnetic pole number of the outer rotor 20 becomes 16.

As shown in FIG. 8, magnetic flux out of the N pole of the outer magnet 24 passes through the inner rotor 30 through the tee 61, enters the S pole of the outer magnet 24 through another tee 61, passes through the rotor yoke 22, and returns to the N pole of the outer magnet 24.

Here, when the magnetic pole number of the outer rotor 20 is 16, since an air gap that is a gap between the outer magnet 24 of N pole and the tee 61 is smaller than that of a case of 32 poles, induced voltage is increased. Due thereto, it is necessary to allow the magnetic pole number of the outer rotor 20 to be 16 in washing that requires low speed or high torque.

Subsequently, a method of converting magnetic poles of the outer magnets 24 from 32 poles into 16 poles will be described with reference to FIG. 5.

Although there is shown 32 poles in FIG. 5, it is possible to provide 16 poles by converting a magnetic pole of a first magnet from a bottom from S pole into N pole. Magnetization currents are applied to the coils 63 to allow a magnetic field to flow over from a first tee 61 to a second tee 61 from a bottom in a direction as an arrow shown in FIG. 5. As described above, it is possible to reverse a magnetic pole of the first outer magnet 24 from the bottom from S pole into N pole.

Subsequently, a method of converting magnetic poles of the outer magnets 24 from 16 poles into 32 poles will be described with reference to FIG. 7.

Although there is shown 16 poles in FIG. 7, it is possible to provide 32 poles by converting a magnetic pole of a first magnet from a bottom from N pole into S pole. Magnetization currents are applied to the coils 63 to allow a magnetic field to flow over from the first tee 61 to the second tee 61 from the bottom in a direction as an arrow shown in FIG. 7. As described above, it is possible to reverse the magnetic pole of the first outer magnet 24 from the bottom from N pole into S pole.

Also, in an arrangement of the outer magnets 24 shown in FIG. 7, a previous pole may remain at some of the outer magnet 24 that is the first from the bottom. However, magnetization may be completely reversed by performing a plurality of times of magnetization while an angle of the outer rotor 20 and a phase of the magnetization currents that flow through the coils 63 are appropriately adjusted as necessary. An order of performing the above-described plurality of times of magnetization will be described in a following second embodiment that includes the outer rotor 20 formed of an SPM type rotor.

Here, magnetic resistance at a path of magnetic flux that passes through the outer magnet 24 between the magnetized teeth 61 is greater than magnetic resistance at a path of magnetic flux that passes near an air gap of the inner rotor 30. That is, part of magnetic flux that passes through the inner magnet 34 diverges at the inner rotor 30 to pass near the air gap.

Due thereto, since a larger amount of magnetic flux flows through the convertible magnet 25 than the fixed magnet 35 when magnetization currents are supplied, a magnetization force of the convertible magnet 25 becomes greater than a magnetization force of the fixed magnet 35.

Since a magnetic path of magnetic flux for magnetization is adequately set as described above, for example, even when the convertible magnet 25 and the fixed magnet 35 are formed of ferrite magnets having the same coercive force, exclusive magnetic pole conversion of the convertible magnet 25 may be stably performed.

Also, the convertible magnet 25 and the fixed magnet 35 may be configured as two or more types of magnets having different coercive forces. For example, more stable magnetization may be obtained by allowing the coercive force of the fixed magnet 35 to be greater than the coercive force of the convertible magnet 25. Also, a torque balance between the inner rotor 30 and the outer rotor 20 may be easily obtained by using a rare earth resource magnet as the fixed magnet 35 of the inner rotor 30.

Figure 9:
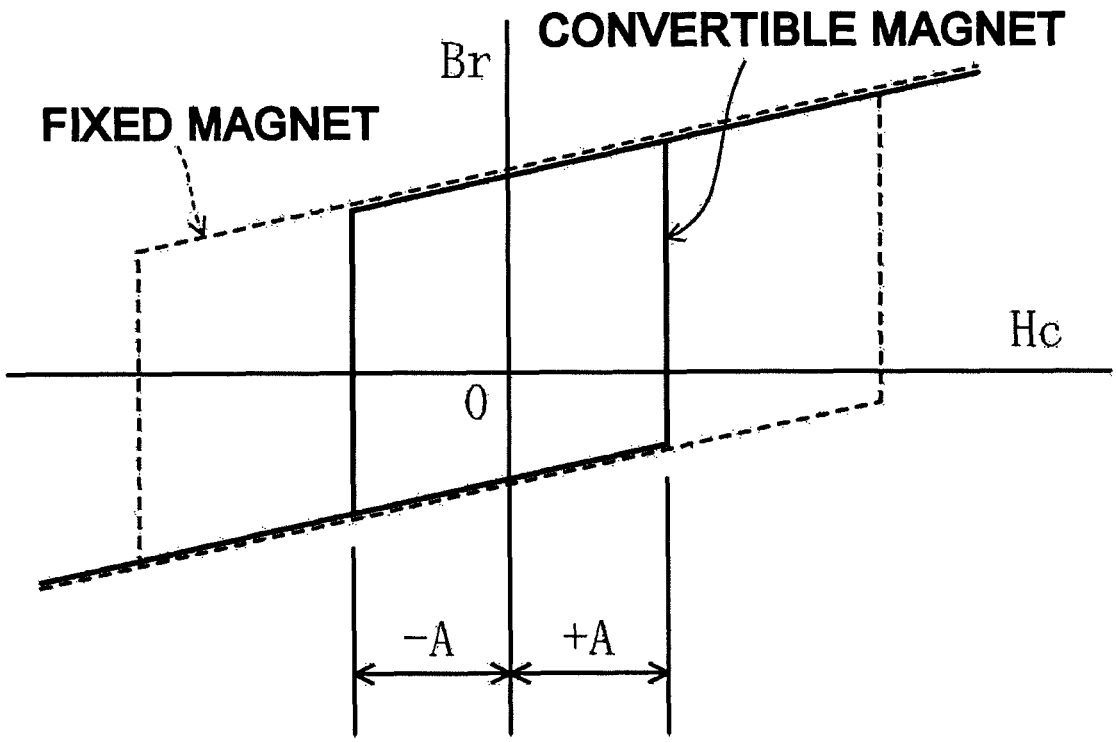
FIG. 9 is a view illustrating curve B-H (a magnetic hysteresis curve) when magnets having different coercive forces are used for the fixed magnet and the convertible magnet.

FIG. 9 is a view illustrating curve B-H (a magnetic hysteresis curve) when magnets having different coercive forces are used for the fixed magnet and the convertible magnet.

In FIG. 9, when a magnetic field that is +A or more and −A or less and does not exceed the coercive force of the fixed magnet 35 is generated by applying a magnetized current to the coil 63, it is possible to reverse the polarity of the convertible magnet 25. The magnetized current is satisfied with a pulse current and magnetization is available using several ten msec.

However, in magnetizing the convertible magnet 25, it is advantageous that a voltage applied to the coil 63 is as high as possible to increase a magnetization current. Also, it is easy to perform high speed rotation such as spin-drying when a voltage is high. However, in a case of washing and rinsing with low speed rotation and high torque, efficiency of the inverter 18 is high when a voltage is not excessively high.

Accordingly, in the first embodiment of the disclosure, a voltage identical to magnetization is supplied to the inverter 18 in magnetization and spin-drying while a voltage lower than the magnetization voltage is supplied to the inverter 18. According thereto, power consumption may be reduced.

Operation of the motor with respect to a rotation mode is discussed herein. Here, an operation of converting a magnetic pole number, in which polarity of the convertible magnet 25 is reversed by supplying a magnetic current to the coil 63, is controlled by the controller 15. That is, based on a control command of the controller 15, the outer rotor 20 and the inner rotor 30 are driven to rotate in a plurality of rotation modes.

FIGS. 10A, 10B, 100, 10D, 10E and 10F are views illustrating rotation modes when a magnetic pole number of the outer rotor is 32.

FIGS. 10A, 10B, 10C, 10D, 10E and 10F illustrate positions of the stator 60, the outer rotor 20, and the inner rotor 30 during an electrical degree 360° in rotation of a three phase motor as six steps or operations and mimetically illustrate a principle in which the outer rotor 20 and the inner rotor 30 rotate.

In FIGS. 10A, 10B, 10C, 10D, 10E and 10F, the outer rotor 20 and the inner rotor 30 have the same pole numbers that are 32 and a mechanical angle thereof is 45°. When driving currents are applied to the coils 63 of three phases such as a U phase, a V phase, and a W phase, a magnetic pole is generated at the teeth 61. The magnetic pole has opposite poles at sides of the teeth 61 toward the inner rotor 30 and the outer rotor 20.

Figure 10A:
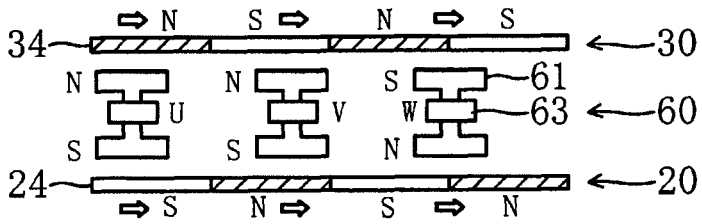

In a first step shown in FIG. 10A, sides of the U phase and V phase teeth 61 toward the inner rotor 30 have N poles and a side of a W phase tee 61 toward the inner rotor 30 has S pole. Due thereto, sides of the U phase and V phase teeth 61 toward the outer rotor 20 have S poles and a side of the W phase tee 61 toward the outer rotor 20 has N pole. Also, hereinafter, only poles of the teeth 61 toward the inner rotor 30 will be described.

In the first step, when the outer rotor 20 and the inner rotor 30 deviate at an electrical degree of 180°, a force of rotating in a right direction in FIG. 10 is received as torque.

Figure 10B:
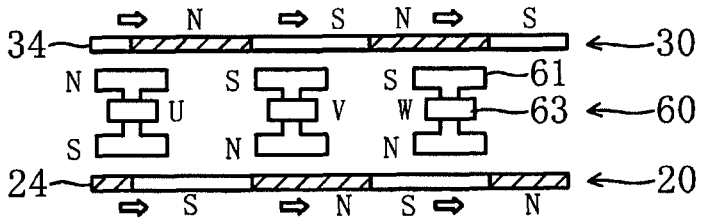
Figure 10C:
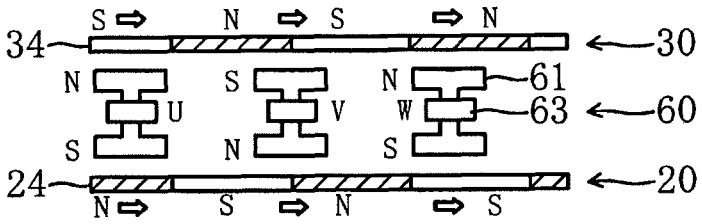

In a second step shown in FIG. 10B, a magnetic pole of the V phase tee 61 is reversed. Due thereto, the V phase tee 61 has S pole while the U phase tee 61 toward the inner rotor 30 has N pole and the outer rotor 20 and the inner rotor 30 move in the right direction while the W phase tee 61 has S pole.

In a third step shown in FIG. 100, a magnetic pole of the W phase tee 61 is reversed. Due thereto, the W phase tee 61 has N pole and the outer rotor 20 and the inner rotor 30 move in the right direction while the U phase tee 61 toward the inner rotor 30 has N pole and the V phase tee 61 has S pole.

Figure 10D:
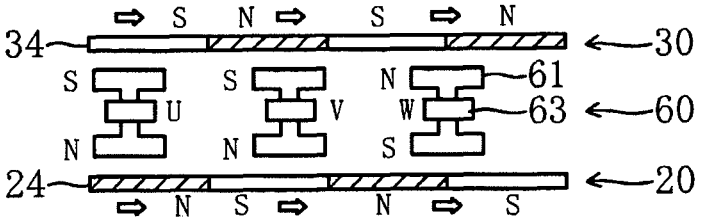

In a fourth step shown in FIG. 10D, a magnetic pole of the U phase tee 61 is reversed. Due thereto, the outer rotor 20 and the inner rotor 30 move in the right direction while the U phase tee 61 toward the inner rotor 30 has S pole, the V phase tee 61 has S pole, and the W phase tee 61 has N pole.

Figure 10E:
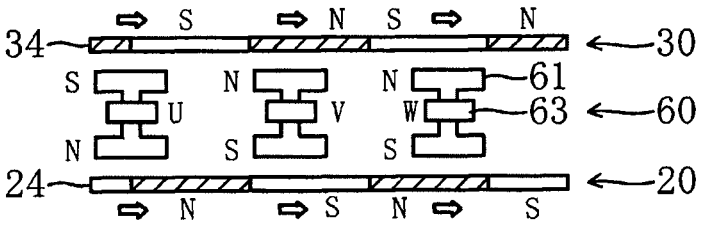

In a fifth step shown in FIG. 10E, the magnetic pole of the V phase tee 61 is reversed. Due thereto, the V phase tee 61 has N pole while the U phase tee 61 toward the inner rotor 30 has S pole and the outer rotor 20 and the inner rotor 30 move in the right direction while the W phase tee 61 has N pole.

Figure 10F:
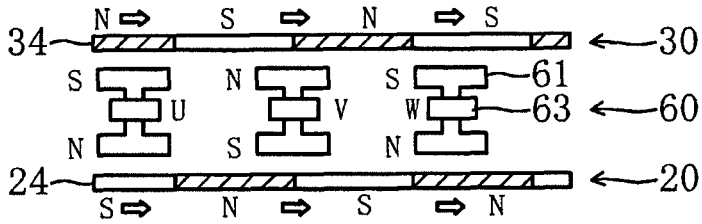

In a sixth step shown in FIG. 10F, the magnetic pole of the W phase tee 61 is reversed. Due thereto, the W phase tee 61 has S pole and the outer rotor 20 and the inner rotor 30 move in the right direction while the U phase tee 61 toward the inner rotor 30 has S pole and the V phase tee 61 has N pole.

As described above, the outer rotor 20 and the inner rotor 30 rotate in the same direction at the same speed. In the first embodiment, the rotation mode is referred to as a synchronous rotation mode. Also, even though phases of the outer rotor 20 and the inner rotor 30 slightly deviate due to load or a change in the load, it has been described that there is no deviation in phase in examples shown in FIGS. 10A to 10F.

Also, in the first embodiment of the disclosure, a position of the inner rotor 30 is recognized by the position sensor 64 installed at a side of the stator 60 toward the inner rotor 30 and three phase currents are applied but the disclosure is not limited thereto. For example, a magnetic sensor that detects a magnet at the inner rotor 30 or the outer rotor 20 may be used instead of the position sensor 64. Also, a so-called sensorless method such as using induced voltages or detection currents may be used. Also, the three phase currents may be applied using other methods such as an encoder and the like.

Subsequently, a rotation mode of a case in which a magnetic pole number of the outer rotor 20 is converted will be described with reference to FIGS. 11A to 11F.

FIGS. 11A, 11B, 11C, 11D, 11E and 11F are views illustrating rotation modes when a magnetic pole number of the outer rotor is 16.

As shown in FIGS. 11A, 11B, 11C, 11D, 11E and 11F, the outer rotor 20 has 16 poles and the inner rotor 30 has 32 poles.

Figure 11A:
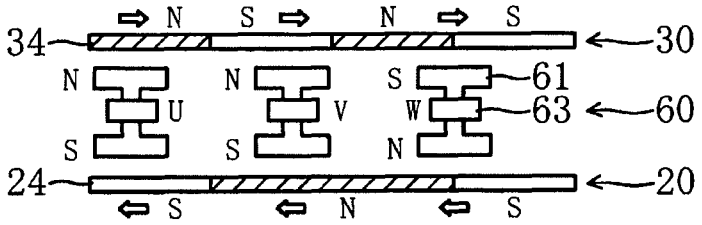
FIGS. 11A, 11B, 11C, 11D, 11E and 11F are views illustrating rotation modes when a magnetic pole number of the outer rotor is 16.

In a first step shown in FIG. 11A, sides of the U phase and V phase teeth 61 toward the inner rotor 30 have N poles and a side of the W phase tee 61 toward the inner rotor 30 has S pole. Due thereto, sides of the U phase and V phase teeth 61 toward the outer rotor 20 have S poles and a side of the W phase tee 61 toward the outer rotor 20 has N pole.

In the first step, the inner rotor 30 receives a force of rotating in a right direction of FIG. 11A as torque. Meanwhile, the outer rotor 20 receives a force of rotating in a left direction of FIG. 11A as torque.

Figure 11B:
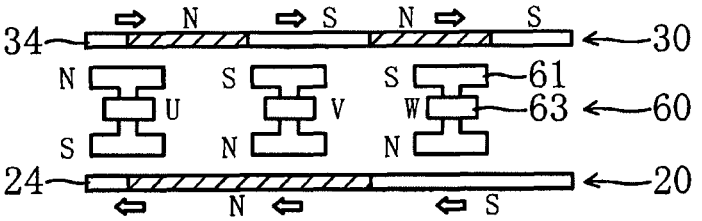

In a second step shown in FIG. 11B, a magnetic pole of the V phase tee 61 is reversed. Due thereto, the V phase tee 61 has S pole while the U phase tee 61 toward the inner rotor 30 has N pole and the inner rotor 30 moves in the right direction and the outer rotor 20 moves in the left direction while the W phase tee 61 has S pole.

Figure 11C:
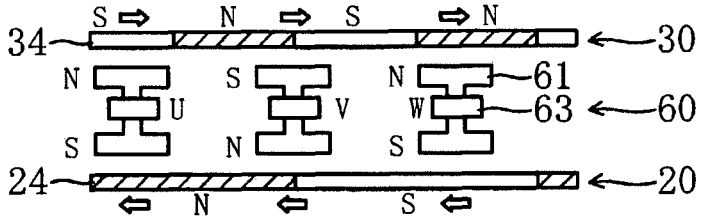

In a third step shown in FIG. 11C, a magnetic pole of the W phase tee 61 is reversed. Due thereto, the W phase tee 61 has N pole and the inner rotor 30 moves in the right direction and the outer rotor 20 moves in the left direction while the U phase tee 61 toward the inner rotor 30 has N pole and the V phase tee 61 has S pole.

Figure 11D:
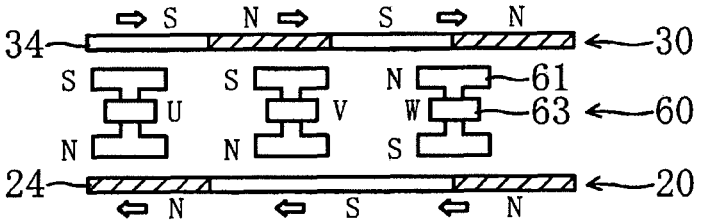

In a fourth step shown in FIG. 11D, a magnetic pole of the U phase tee 61 is reversed. Due thereto, the U phase tee 61 toward the inner rotor 30 has S pole, the V phase tee 61 has S pole, the W phase tee 61 remain in N pole, the inner rotor 30 moves in the right direction, and the outer rotor 20 moves in the left direction.

Figure 11E:
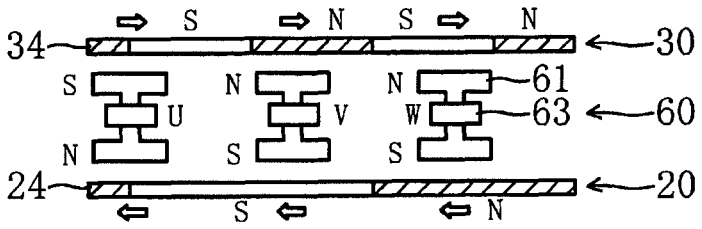

In a fifth step shown in FIG. 11E, the magnetic pole of the V phase tee 61 is reversed. Due thereto, the V phase tee 61 has N pole while the U phase tee 61 toward the inner rotor 30 has S pole and the inner rotor 30 moves in the right direction and the outer rotor 20 moves in the left direction while the W phase tee 61 has N pole.

Figure 11F:
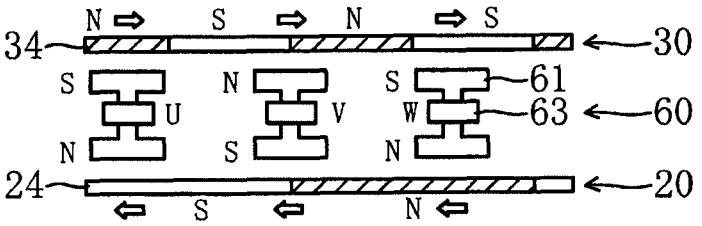

In a sixth step shown in FIG. 11F, the magnetic pole of the W phase tee 61 is reversed. Due thereto, the W phase tee 61 has S pole, the inner rotor 30 moves in the right direction, and the outer rotor 20 moves in the left direction while the U phase tee 61 toward the inner rotor 30 has S pole and the V phase tee 61 has N pole. Here, a movement amount of the outer rotor 20 is twice as much as that of the inner rotor 30.

As described above, the outer rotor 20 and the inner rotor 30 rotate in different directions at different speeds. In the first embodiment, the rotation mode is referred to as a contrary rotation mode.

Also, as the rotation mode, a different rotation ratio or the same rotation ratio of the synchronous rotation mode and the contrary rotation mode may be configured by a combination of magnetic pole numbers in addition to the first embodiment of the disclosure. As described above the synchronous rotation mode or the contrary rotation mode includes rotation modes of rotating with a random rotation ratio or rotating with different torque by rotating in the same direction or a different direction.

Although not shown in detail in FIGS. 11A, 11B, 11C, 11D, 11E and 11F, information of a position relationship of the outer rotor 20, the inner rotor 30, and the stator 60 may be obtained using a method, for example, a sensorless method, a position sensor, an encoder and the like and a phase difference $\Delta\theta$ is calculated by the controller 15 based on a position relationship of the outer magnet 24, the inner magnet 34, and the coil 63. It will be described with reference to FIGS. 12 to 14.

Figure 12:
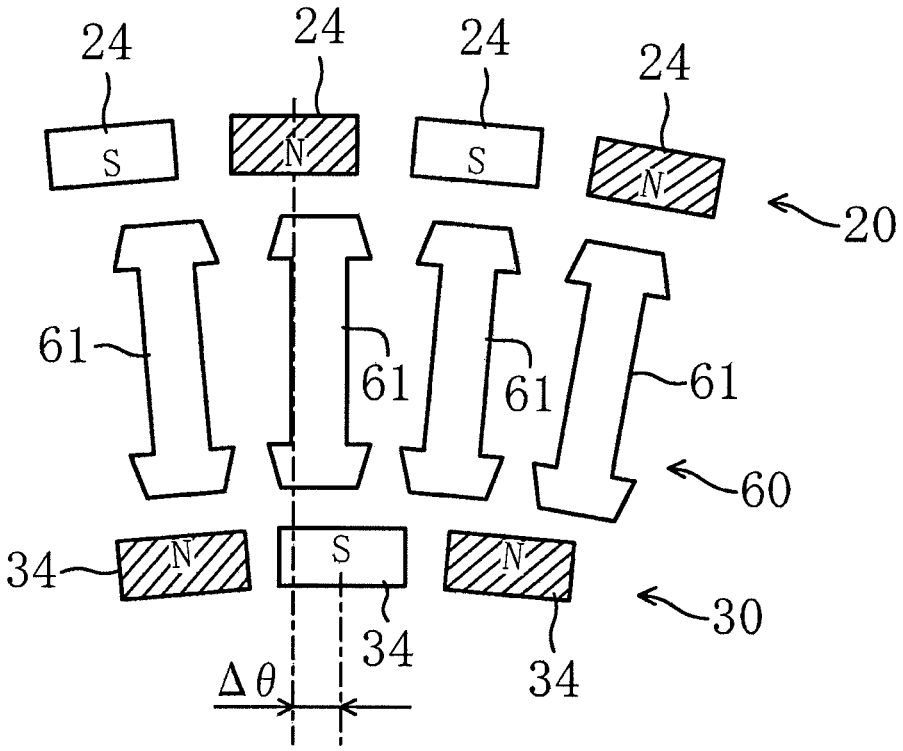
FIG. 12 is a view illustrating a phase difference between the outer rotor and the inner rotor.
Figure 13:
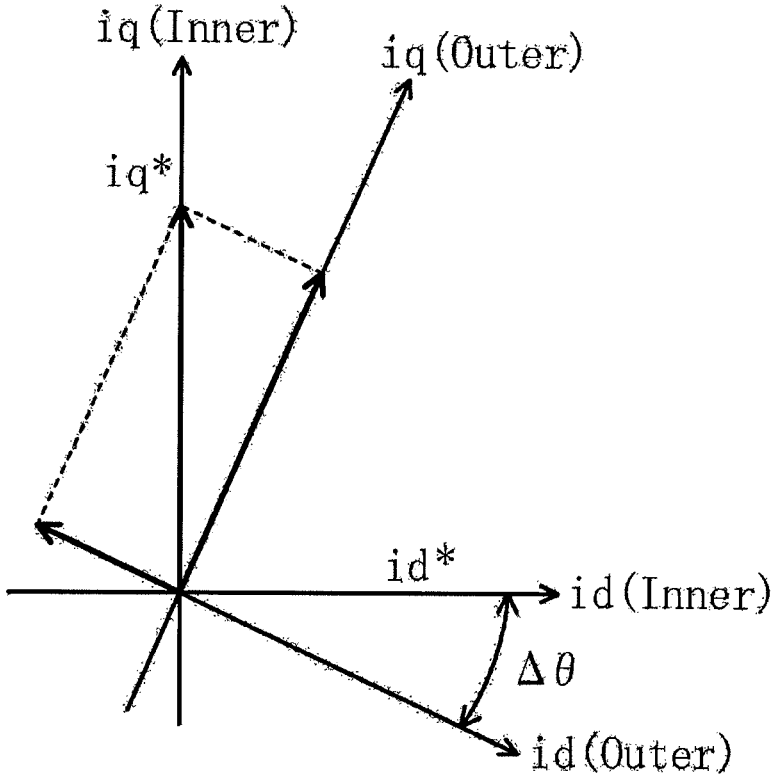
FIG. 13 is a view illustrating a relationship between a d-axis current and a q-axis current.
Figure 14:
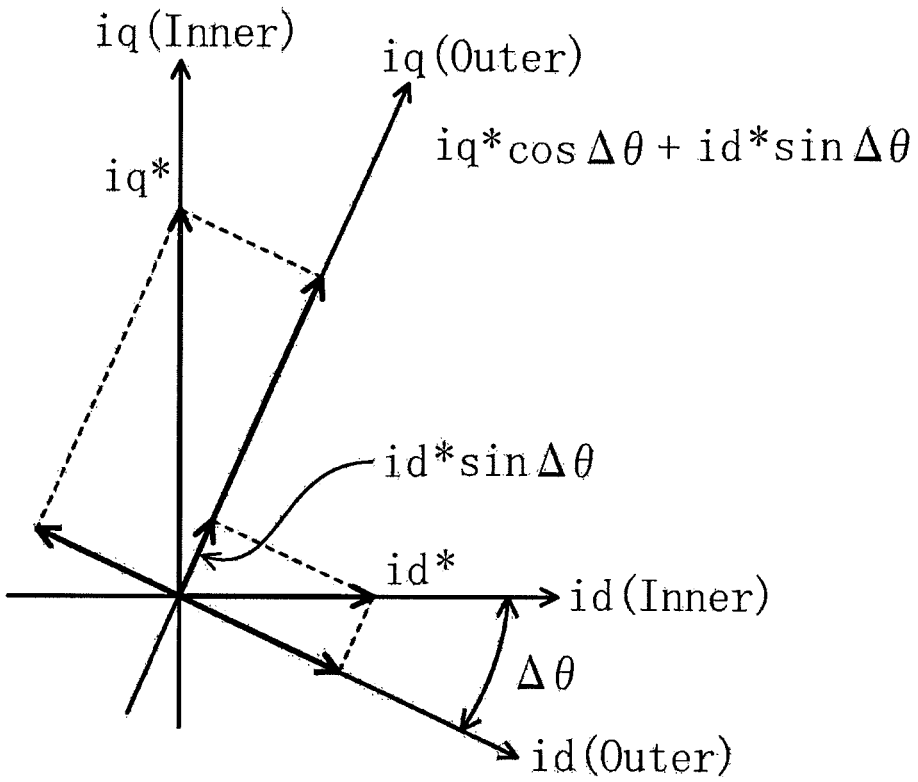
FIG. 14 is a view illustrating a relationship between the d-axis current and the q-axis current for decreasing a phase difference.

FIG. 12 is a view illustrating a phase difference between the outer rotor and the inner rotor, FIG. 13 is a view illustrating a relationship between a d-axis current and a q-axis current, and FIG. 14 is a view illustrating a relationship between the d-axis current and the q-axis current for decreasing a phase difference.

In an example shown in FIG. 12, a phase difference between the outer magnet 24 of the outer rotor 20, which has N pole, and the inner magnet 34 of the inner rotor 30, which has S pole, is referred to as Δθ.

Hereinafter, control when phases mutually deviate and a phase difference occurs while the outer rotor 20 and the inner rotor 30 are rotated in the contrary rotation mode will be described.

In the first embodiment of the disclosure, the rotation of the inner rotor 30 is mainly controlled and the rotation of the outer rotor 20 follows the control of the inner rotor 30. Here, when a phase difference Δθ occurs between the outer rotor 20 and the inner rotor 30, torque of the outer rotor 20 that is an uncontrolled part is reduced. Also, at this time, a q-axis current value iq(Outer) of the outer rotor 20 is iq(Outer)=iq*cos Δθ (refer to FIG. 13).

Accordingly, a d-axis current value id(Inner) of the inner rotor 30 is determined based on the magnitude of the phase difference Δθ as shown in FIG. 14 and applied to the coil 63. In detail, the d-axis current value id(Inner) of the inner rotor 30 is determined using a q-axis current value iq(Inner) and the phase difference Δθ between the outer rotor 20 and the inner rotor 30 as shown in Equation (1).

$$id(\text{Inner})=iq(\text{Inner})\cdot(1-\cos\Delta\theta)/\sin\Delta\theta \quad (1)$$

Also, when the d-axis current value id(Inner) is applied to the coil 63, a q-axis current value iq(Outer) of the inner rotor 30 is increased. In detail, the q-axis current value iq(Outer) of the inner rotor 30 is determined as shown in Equation (2).

$$iq(\text{Outer})=iq^*\cos\Delta\theta+id^*\sin\Delta\theta \quad (2)$$

That is, since the q-axis current value iq(Outer) of the outer rotor 20 is increased by only id*sin Δθ and the outer rotor 20 accelerates due to an increased amount, the phase difference Δθ may be decreased.

Due thereto, step-out resisting forces of the outer rotor 20 and the inner rotor 30 increase to stably rotate even in the contrary rotation mode.

Subsequently, a case in which the outer rotor 20 and the inner rotor 30 are driven in a spin-drying mode that is a high speed rotation mode at a higher speed than a certain number of rotations will be described. In the spin-drying mode, the outer rotor 20 and the inner rotor 30 are driven to rotate in the synchronous rotation mode.

Figure 15:
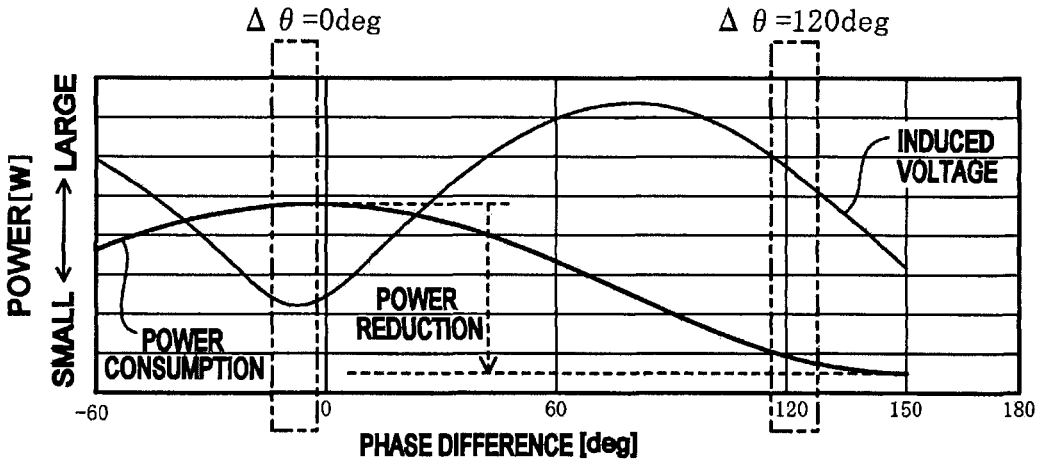
FIG. 15 is a graph illustrating a relationship among a phase difference, an induced voltage, and power consumption.

FIG. 15 is a graph illustrating a relationship among a phase difference, an induced voltage, and power consumption.

In FIG. 15, power consumption becomes maximal when a phase difference Δθ is near 0°. Meanwhile, although power consumption is minimal when the phase difference Δθ is near 180°, a step out occurs when the phase difference Δθ exceeds 180°. Due thereto, it is necessary to control the phase difference Δθ to be smaller than 180°.

Here, to stably operate without step out and simultaneously to suppress power consumption to be low, as shown in FIG. 15, it is necessary to control the phase difference Δθ to be within a range between 90° and 180°. Also, it may be known from various experimental results that it is most effective to set the phase difference Δθ to be near 150°. Due thereto, in the spin-drying mode, it is preferable to set the phase difference Δθ between the outer rotor 20 and the inner rotor 30 to be 150±10°.

Subsequently, a case in which the outer rotor 20 and the inner rotor 30 are driven in a synchronous rotation mode will be described. In the synchronous rotation mode, the outer rotor 20 and the inner rotor 30 synchronously rotate while one magnetic pole of the outer rotor 20 or the inner rotor 30 is delayed from another by a certain phase. Accordingly, rotations of the outer rotor 20 and the inner rotor 30 are controlled to allow a magnetic flux amount for the rotations of the outer rotor 20 and the inner rotor 30 to be smaller than that for low speed rotation thereof. In detail, since a magnetic flux amount is decreased when a phase difference is increased, magnetic flux densities of air gaps at the outer rotor 20 and the inner rotor 30 may be reduced without step out by adequately controlling a delayed phase as described above.

Accordingly, an induced voltage generated at the coil 63 may be suppressed, and particularly, efficiency of high speed rotation may be improved or it is possible to drive using a low voltage even in high speed rotation.

Subsequently, a method of detecting step out when a great external load is applied as a disturbance from outside to the outer rotor 20 or the inner rotor 30 will be described. As described above, although it is controlled not to step out, step out may occur when an unexpectedly great load is applied. Upon step out, since a sound or vibration occurs accompanying a great spin fluctuation, the sound or vibration may be estimated and the occurrence of step out may be reduced by allowing a motor to stop before the step out.

Hereinafter, a detailed method of estimating step out will be described with reference to FIG. 16.

Figure 16:
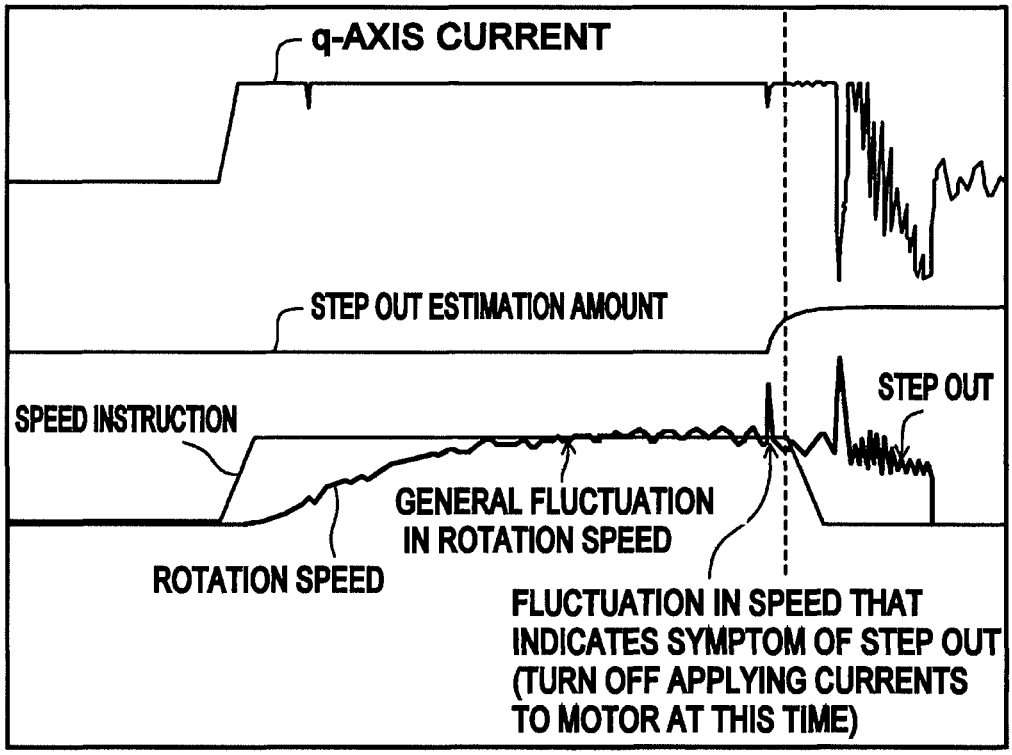
FIG. 16 is a graph for estimating step out.

FIG. 16 is a graph for estimating step out.

In FIG. 16, it has been checked by tests of the inventor(s) that a rotation speed of the motor 12 changes when it becomes closer to a step out phenomenon.

In detail, variance may be detected by comparing a necessary rotation speed based on a speed instruction with an actual rotation speed. At a point in time at which variance is small, although step out does not occur yet and the inner rotor 30 and the outer rotor 20 rotate while synchronously follow, step out occurs when variance increases to be higher than a certain level. Due thereto, when the variance increases to the certain value, a great electronic torque variance that occurs in step out may be previously turned off by stopping currents to the motor 12.

As described above, the motor 12 according to the first embodiment of the disclosure may rotate the outer rotor 20 and the inner rotor 30 in a plurality of rotation modes using a simple configuration. That is, since it is unnecessary to supply composite currents to independently rotate two rotors as general, a plurality of inverters 18 for supplying the composite currents are unnecessary. Accordingly, compact and low-priced products are available by decreasing a volume of the inverter 18.

Also, since it is unnecessary to separate the composite currents, there is little effect of harmonic currents and there is no vibration or noise caused by harmonic distortion.

Also, when the motor 12 is loaded in the washing machine 1, a low-priced system configuration capable of corresponding to driving modes minimally necessary, for example, a synchronous rotation mode or a contrary rotation mode may be provided.

Also, since magnetic pole conversion of the convertible magnet 25 using a saturated magnetization area is performed by supplying magnetization currents to the coil 63, a magnetic flux amount is stable and noise or vibration caused by a deviation in the magnetic flux amount is hardly generated.

Figure 17:
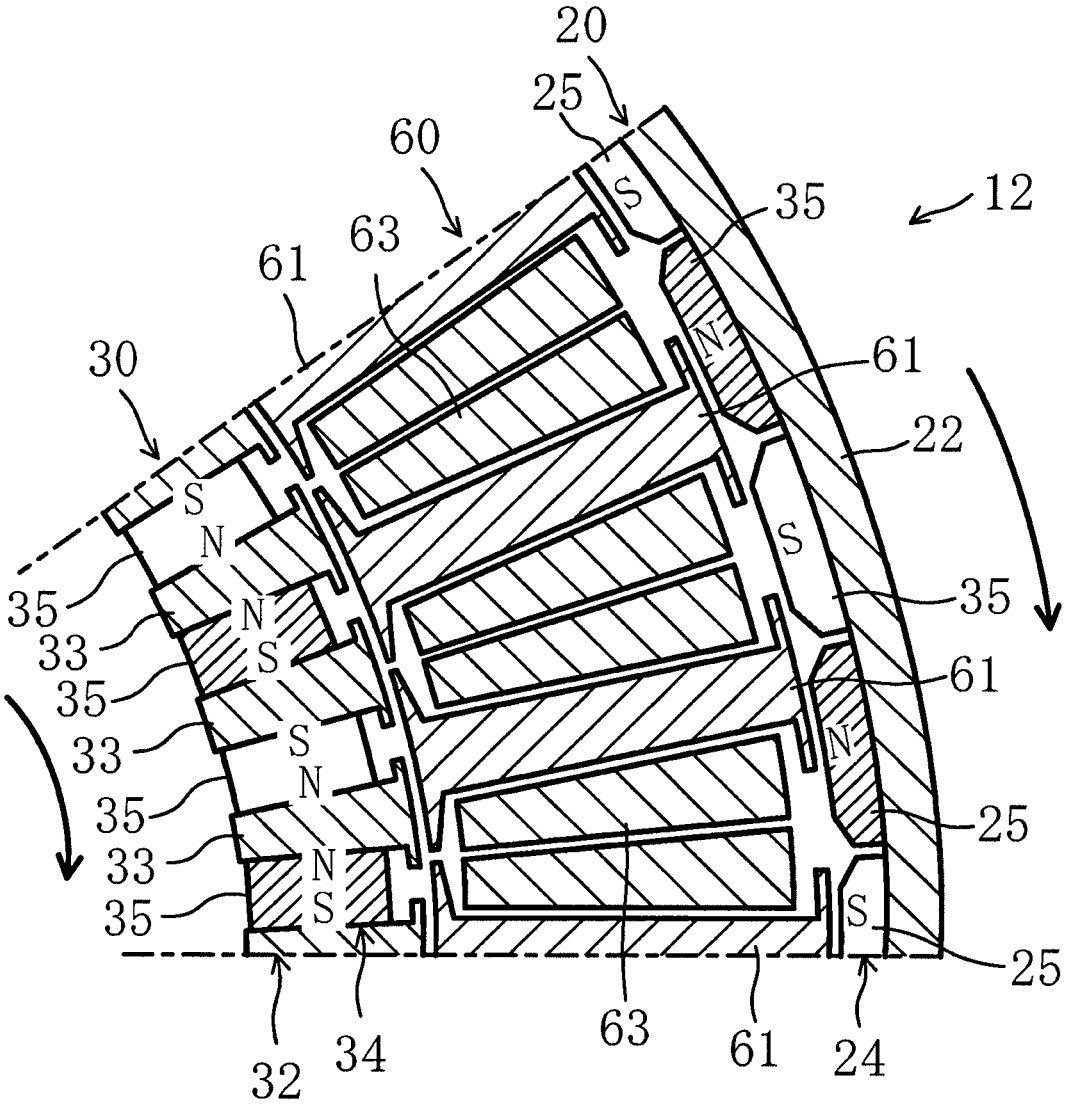
FIG. 17 is a top cross-sectional view illustrating a configuration of the motor according to the second embodiment of the disclosure and illustrates that the number of magnetic poles of the outer rotor is 32.
Figure 18:
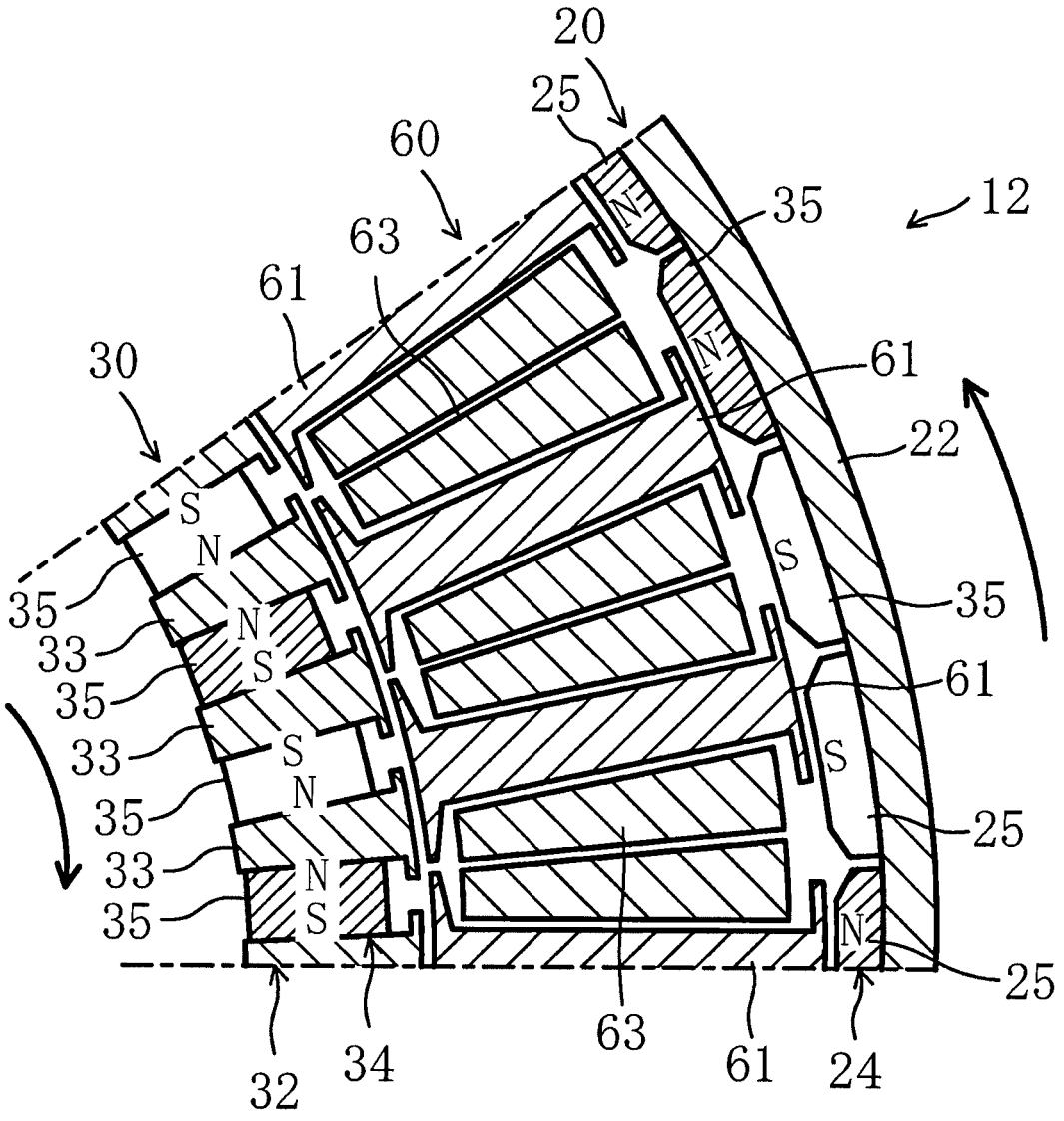
FIG. 18 is a top cross-sectional view illustrating the configuration of the motor according to the second embodiment of the disclosure and illustrates that the number of magnetic poles of the outer rotor is 16.

FIG. 17 is a top cross-sectional view illustrating a configuration of the motor according to the second embodiment of the disclosure and illustrates that the number of magnetic poles of the outer rotor is 32, and FIG. 18 is a top cross-sectional view illustrating the configuration of the motor according to the second embodiment of the disclosure and illustrates that the number of magnetic poles of the outer rotor is 16.

Hereinafter, like reference numerals refer to like components in the above-described first embodiment and only differences will be described.

In FIG. 17, the inner rotor 30 is a spoke type rotor in which thirty two inner magnets 34 are arranged at intervals in a radial shape in a circumferential direction and are installed and fixed to the inner peripheral wall 32. All of the inner magnets 34 are formed of the fixed magnets 35. The rotor core 33 is disposed between the inner magnets 34 in the circumferential direction.

The outer rotor 20 is an SPM type rotor, and thirty two outer magnets 24 are arranged to allow S poles and N poles to be alternately arranged in the circumferential direction and fixed to the inner surface of the rotor yoke 22.

Here, the outer magnets 24 include the convertible magnets 25 and the fixed magnets 35. In detail, among five outer magnets 24 shown in FIG. 17, first, second, and fifth magnets from the bottom are formed of convertible magnets 25. Also, third and fourth magnets from the bottom are formed of fixed magnets 35. That is, two adjacent magnets are formed of magnets having the same function.

Also, when magnetic poles of all the convertible magnets 25 are reversed by supplying magnetization currents to the coil 63, as shown in FIG. 18, the first and fifth convertible magnets 25 from the bottom are reversed from S poles to N poles and the second convertible magnet 25 from the bottom is reversed from N pole to S pole. A group of the two adjacent magnets having S poles and a group of the two adjacent magnets having N poles are converted to be alternately arranged in a circumferential direction as described above in such a way that a magnetic pole number of the outer rotor 20 becomes 16.

Here, when the magnetic pole number of the outer rotor 20 is 32 and driving currents are supplied to the coils 63, as shown in an arrow of FIG. 17, both the outer rotor 20 and the inner rotor 30 rotate clockwise. That is, it is possible to drive in a synchronous rotation mode.

Meanwhile, when the outer rotor 20 has 16 magnetic poles and driving currents are supplied to the coils 63, as shown in an arrow of FIG. 18, both the outer rotor 20 rotates counterclockwise and the inner rotor 30 rotates clockwise. That is, it is possible to drive in a contrary rotation mode.

Also, the numbers of the inner magnets 34 and the outer magnets 24 are merely examples but not limited thereto.

Hereinafter, a sequence of magnetizing the convertible magnets 25 through a plurality of times will be described with reference to FIGS. 19 to 24. Hereinafter, a case of changing the magnetic pole number of the outer rotor 20 from 32 to 16 will be described. Also, since a case of changing the magnetic pole number of the outer rotor 20 from 16 to 32 may be performed by reversely performing a following sequence, a description thereof will be omitted.

FIGS. 19 to 24 are top cross-sectional views illustrating a sequence of magnetization through a plurality of times.

Figure 19:
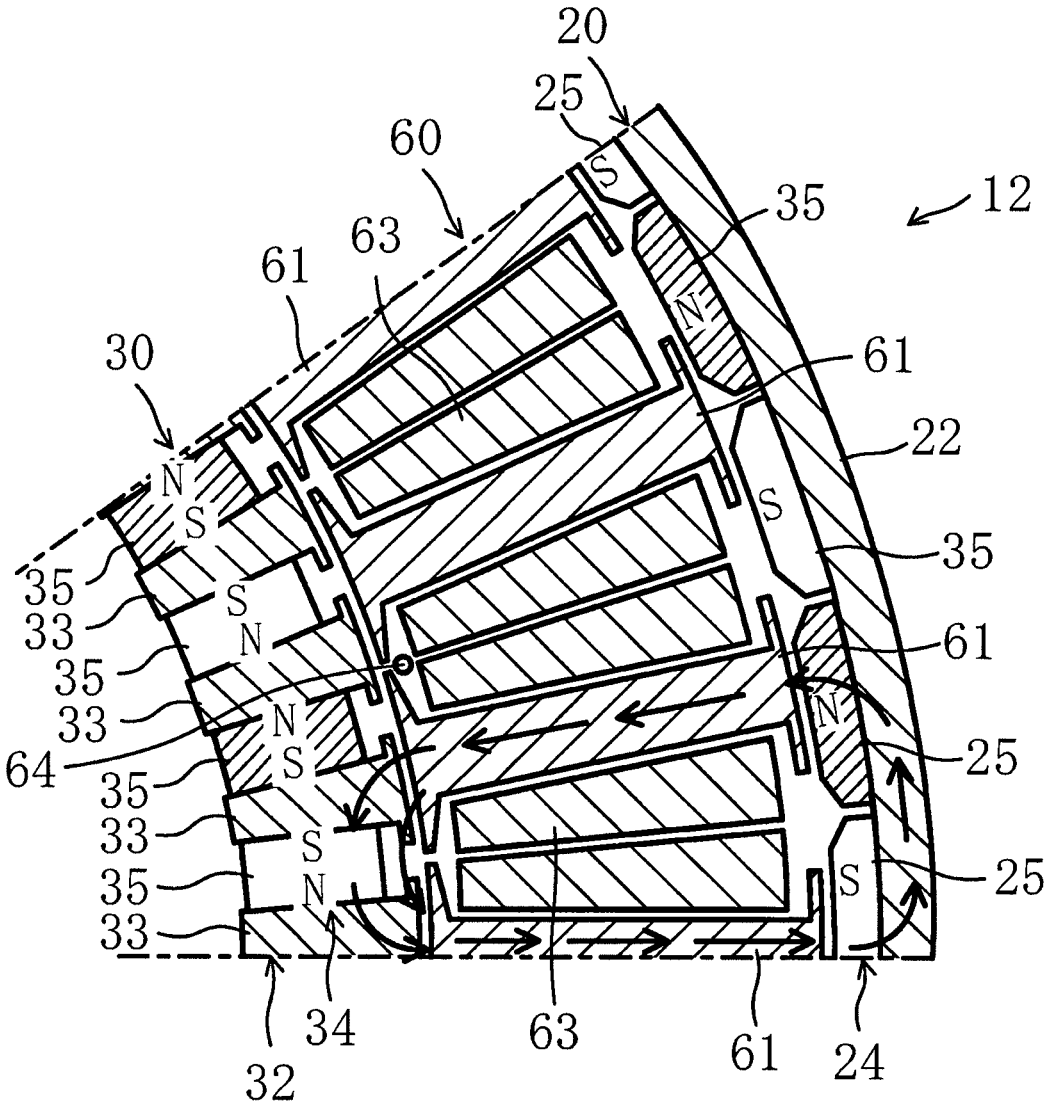
FIGS. 19 to 24 are top cross-sectional views illustrating a sequence of magnetization through a plurality of times.

As shown in FIG. 19, a position of the outer rotor 20 is determined. In detail, magnetization currents are applied to the coils 63 to allow a magnetic field to flow over from a first tee 61 (a U phase) to a second tee 61 (a W phase) from the bottom in a direction as shown in an arrow of FIG. 19. Here, currents of 5A are applied to generate a magnetic field capable of fixing the outer rotor 20 to a position in FIG. 19. Accordingly, magnetic poles of the outer rotor 20 and the inner rotor 30 facing the teeth 61 keep their balance and stop at positions shown in FIG. 19.

Figure 20:
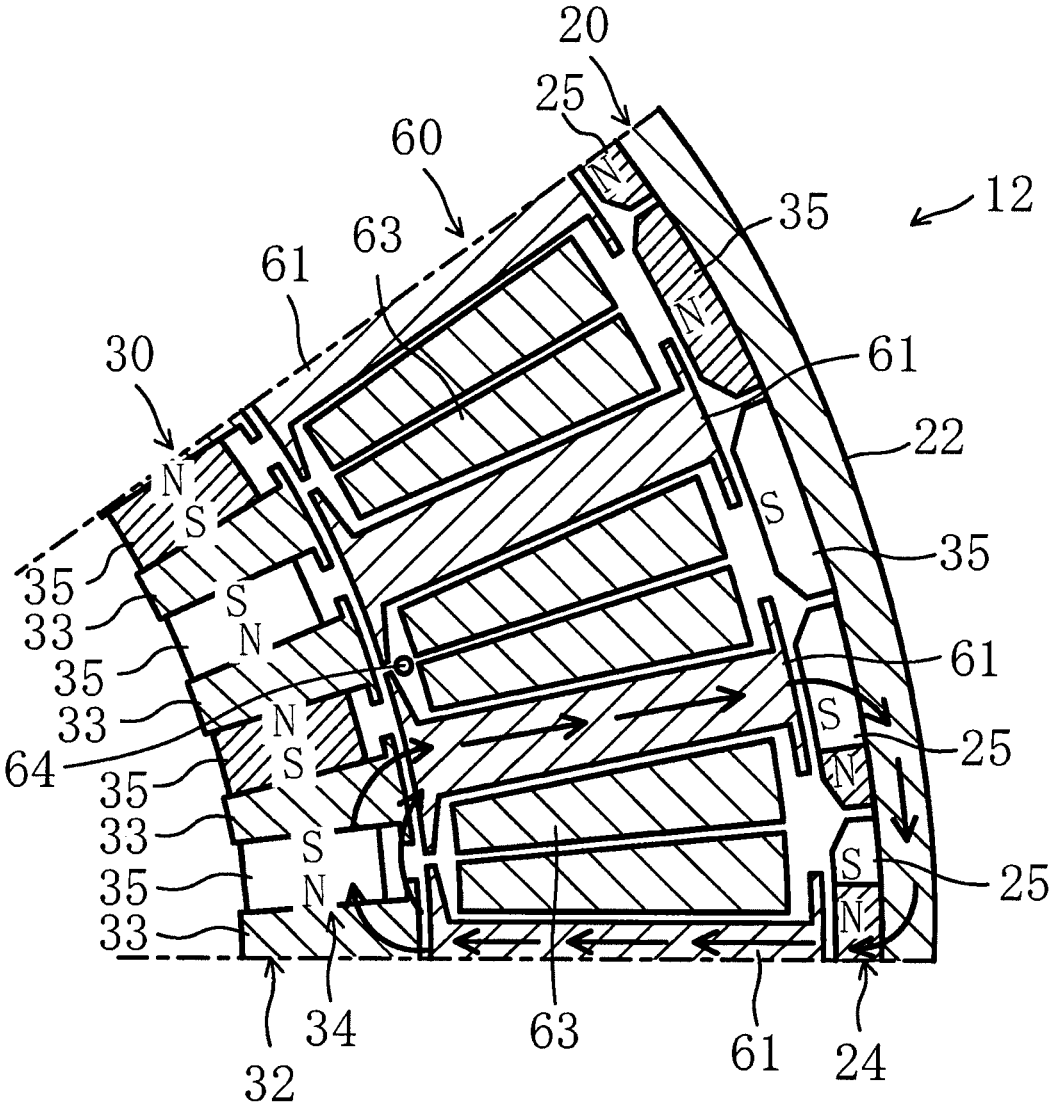

Sequentially, as shown in FIG. 20, magnetization currents are applied to the coils 63 to allow a magnetic field to flow over from the first tee 61 to the second tee 61 from the bottom at the position where the outer rotor 20 stops in a direction as shown in an arrow of FIG. 20. Here, currents for magnetization higher than that for determining the position of the outer rotor 20, for example, currents about 30 A are applied. Accordingly, the first and second convertible magnets 25 from the bottom, as shown in FIG. 20, opposite magnetic poles are partially magnetized.

Figure 21:
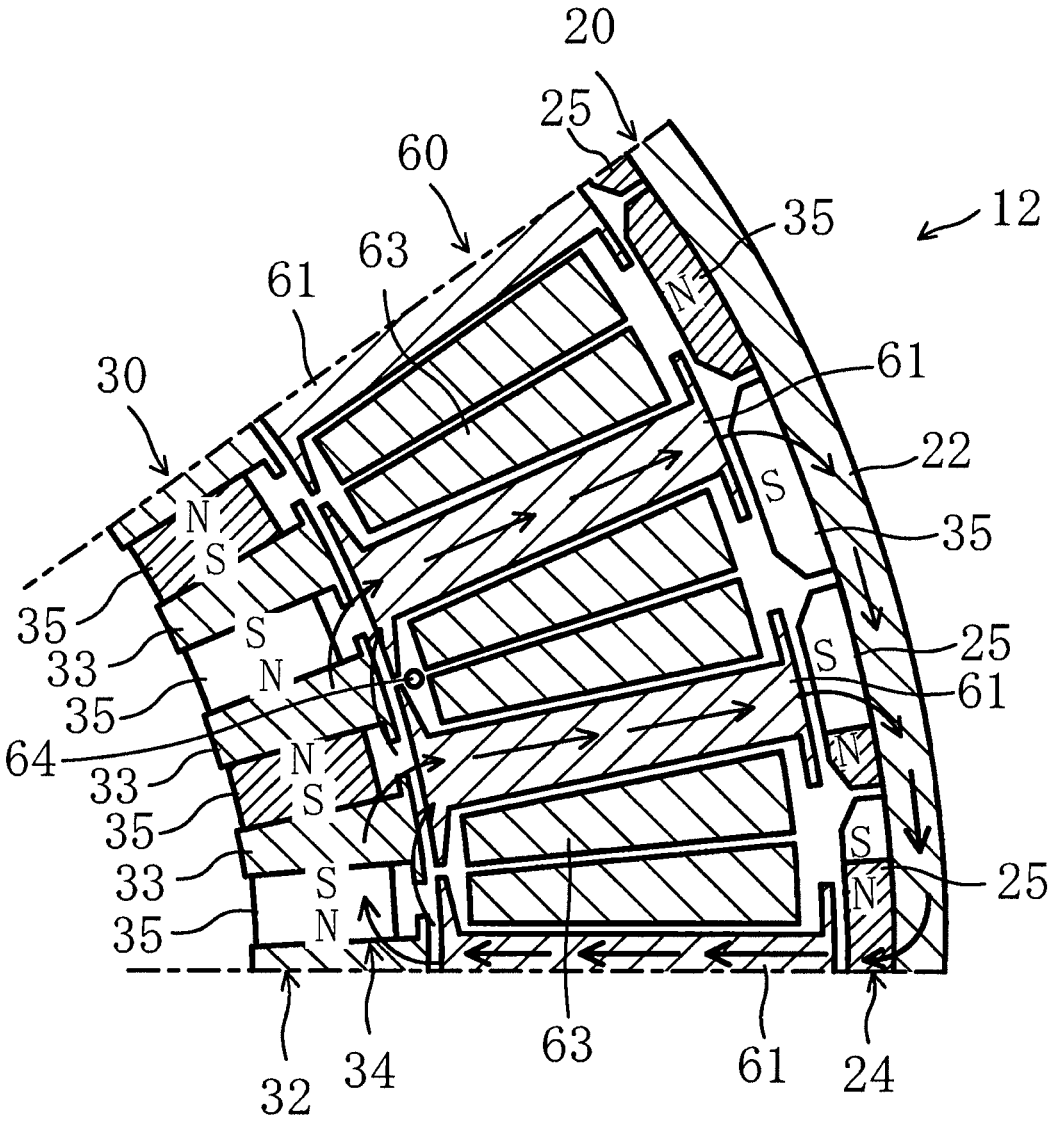

Sequentially, as shown in FIG. 21, currents are applied to the coil 63 to allow a magnetic field to flow through the first (a U phase), second (a W phase), and third (a V phase) teeth 61 from the bottom in a direction as shown in an arrow of FIG. 21. Here, currents of 5A are applied to generate a magnetic field capable of fixing the outer rotor 20 to a position in FIG. 21. Accordingly, magnetic poles of the outer rotor 20 and the inner rotor 30 keep their balance and stop at positions shown in FIG. 21.

Figure 22:
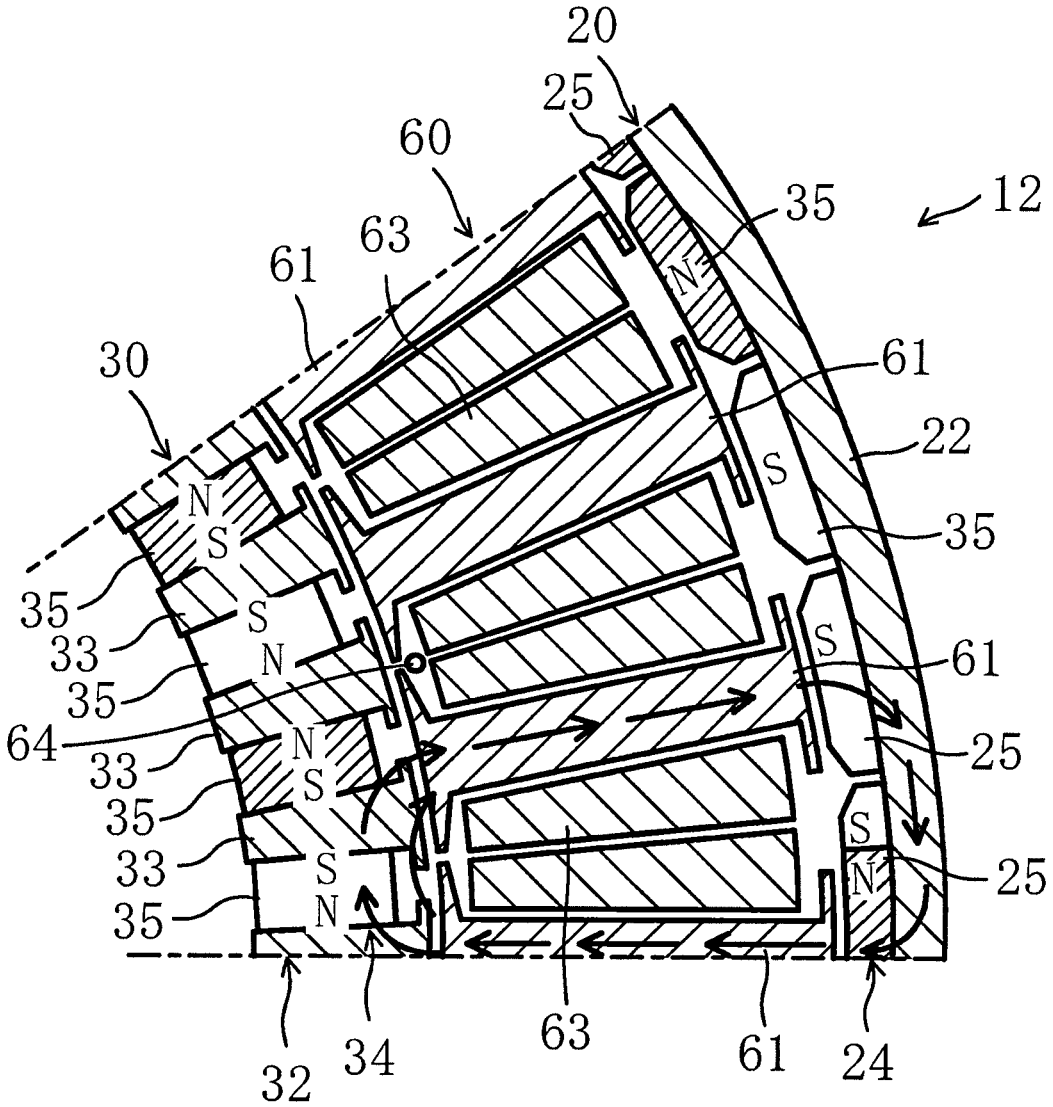

Sequentially, as shown in FIG. 22, magnetization currents are applied to the coils 63 to allow a magnetic field to flow over from the first tee 61 to the second tee 61 from the bottom at the position where the outer rotor 20 stops in a direction as shown in an arrow of FIG. 22. Here, currents for magnetization higher than that for determining the position of the outer rotor 20, for example, currents about 30 A are applied. Here, since an area of the second convertible magnet 25 from the bottom that faces the tee 61 spreads, a reversal of a magnetic pole from N pole to S pole is completed.

Figure 23:
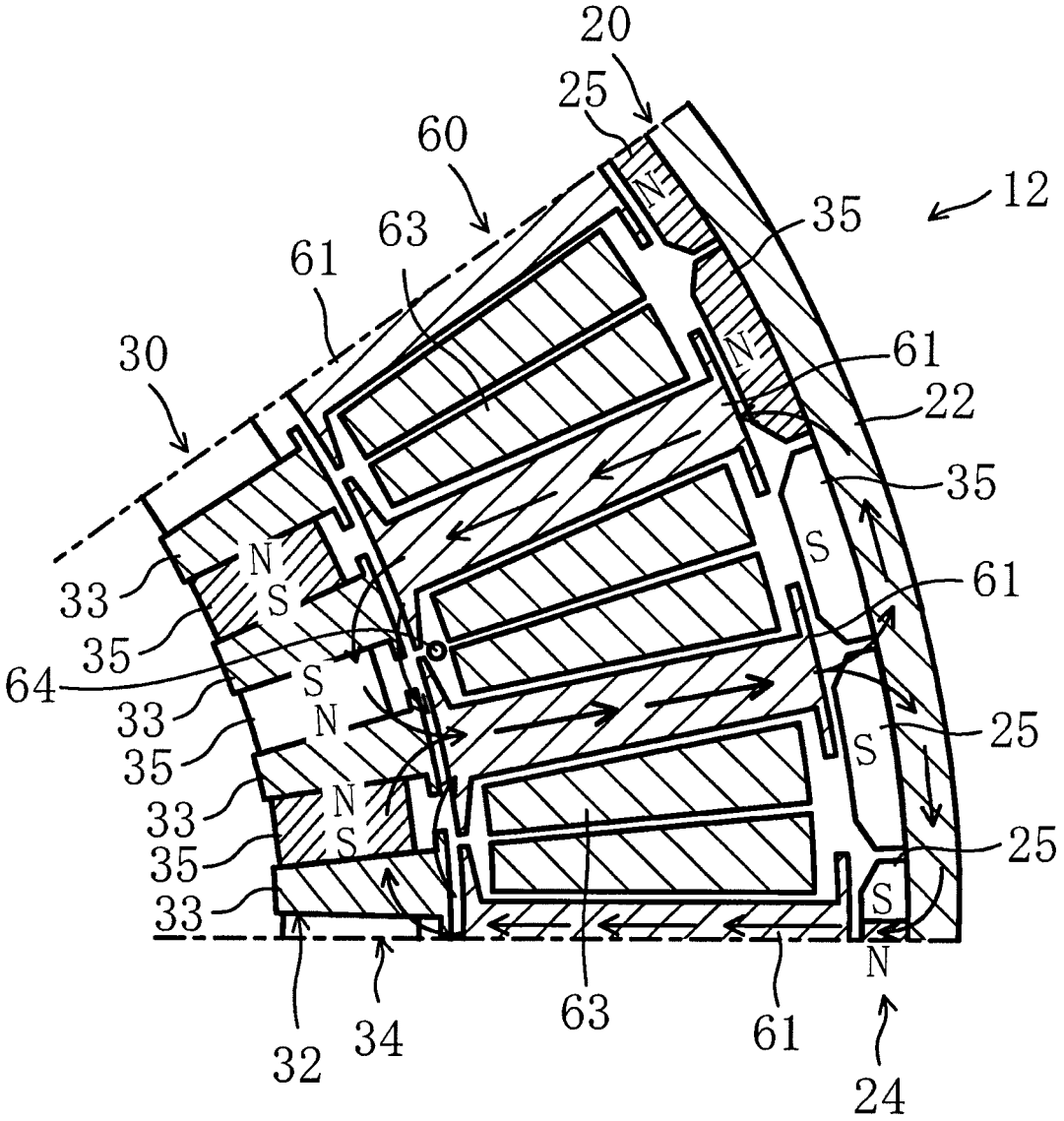

Sequentially, as shown in FIG. 23, currents are applied to the coil 63 to allow a magnetic field to flow through the first, second, and third teeth 61 from the bottom in a direction as shown in an arrow of FIG. 23. Here, currents of 5A are applied to generate a magnetic field capable of fixing the outer rotor 20 to a position in FIG. 23. Accordingly, magnetic poles of the outer rotor 20 and the inner rotor 30 facing the teeth 61 keep their balance and stop at positions shown in FIG. 23.

Figure 24:
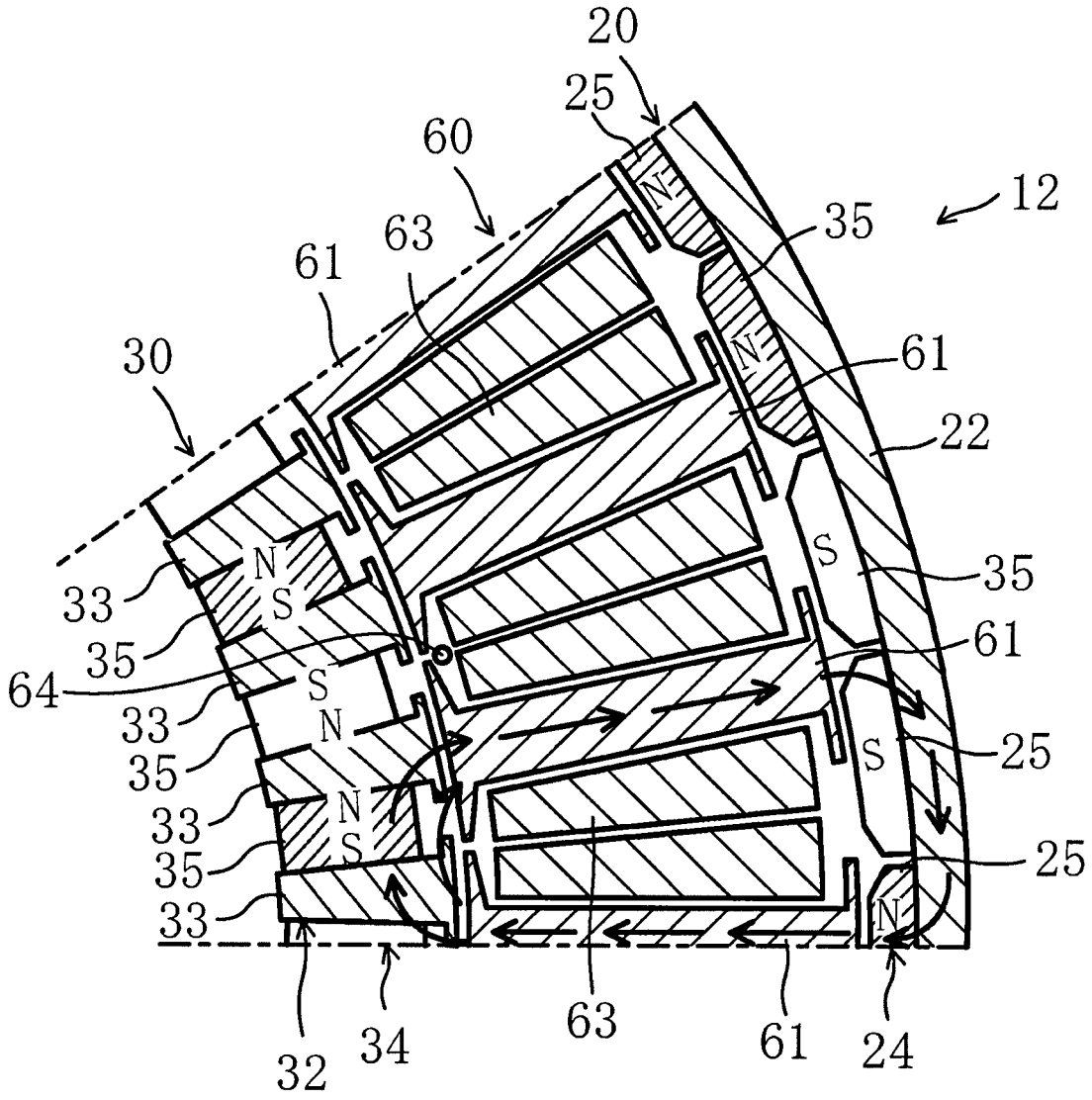

Sequentially, as shown in FIG. 24, magnetization currents are applied to the coils 63 to allow a magnetic field to flow over from the first tee 61 to the second tee 61 from the bottom at the position where the outer rotor 20 stops in a direction as shown in an arrow of FIG. 24. Here, currents for magnetization higher than that for determining the position of the outer rotor 20, for example, currents about 30 A are applied. Here, since an area of the first convertible magnet 25 from the bottom that faces the tee 61 spreads, a reversal of a magnetic pole from S pole to N pole is completed.

Also, in the second embodiment of the disclosure, although the magnetization is performed while the outer rotor 20 stops rotation, the magnetization may be performed during low-speed rotation. In this case, after the magnetization is performed at least one time while the outer rotor 20 stops rotation before initiating the magnetization, a relative position with respect to the tee 61 is changed by rotating the outer rotor 20 at a low speed and residual times of magnetization may be performed. That is, the magnetization currents may be applied when the outer rotor 20 that rotates at a low speed arrives at the position in FIG. 20 and the like. In this case, the magnetization may be performed during the synchronous rotation mode.

Also, to determine the position of the outer rotor 20, a sensorless type position signal may be used or a position signal of the inner magnet 34 at the inner rotor 30 by the position sensor 64 may be used. Also, a position signal obtained by performing a position signal treatment such as leveling of the inner rotor 30 and the outer rotor 20 and the like may be used. Also, in rotation at a low speed, compared with a stationary state, an inertia moment effect during rotation of the outer rotor 20 may be used. Even in a process in which magnetization becomes original magnetization, since a magnetization position may be more precisely determined using a position signal, reversal of magnetic poles may be easily performed with a high degree of precision. Also, when all magnetization processes are performed during rotation while fluctuation in rotation is recognized by controlling the rotation, since the inertia moment effect may be used, it is most effective.

Also, although only a first one time of magnetization in the stationary state has been described, first and second times of magnetization may be performed to convert magnetic poles while rotating after the stationary state. Also, times of magnetization are not limited thereto and may be repeatedly performed to improve the degree of precision to be higher by performing magnetization for magnetic pole conversion.

However, when the magnetization is performed during rotation of the outer rotor 20, a phase of applying a current may be converted according to a movement of the outer rotor 20. It will be described with reference to FIGS. 25 to 30.

Figure 25:
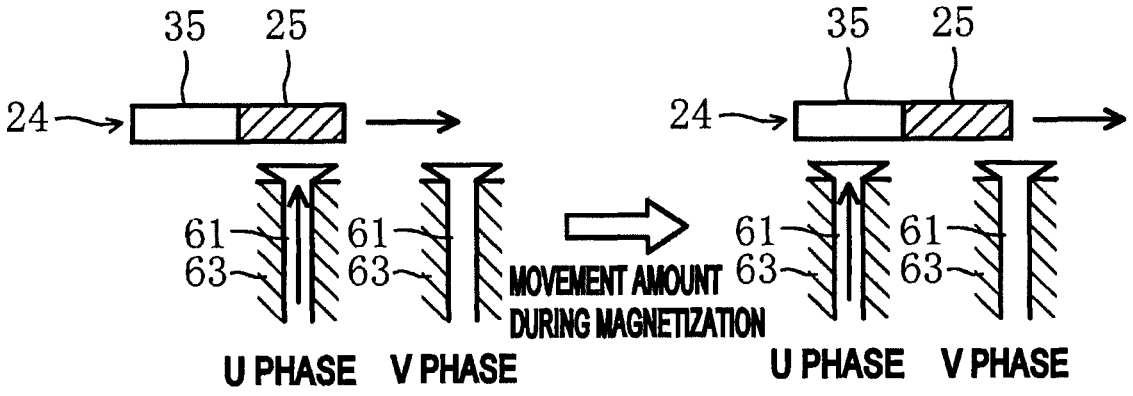
FIG. 25 is a view illustrating a position relationship between the convertible magnet and the tee when a phase of applying a current is not converted.
Figure 26:
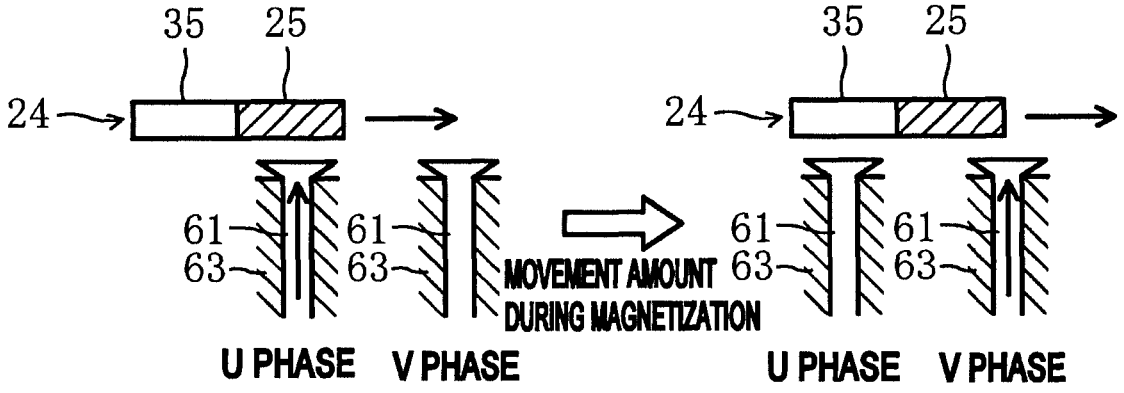
FIG. 26 is a view illustrating a position relationship between the convertible magnet and the tee when the phase of applying a current is converted.
Figure 27:
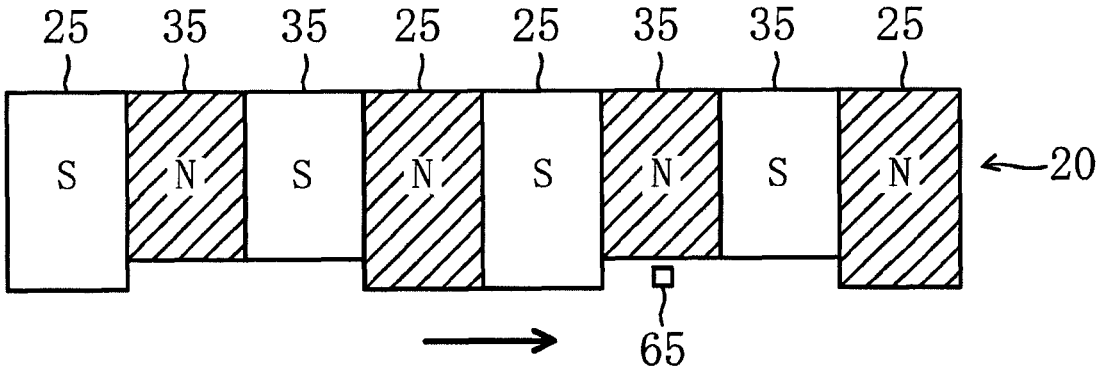
FIG. 27 is a view illustrating a disposition of a magnetic sensor for the convertible magnets and the fixed magnets.
Figure 28:
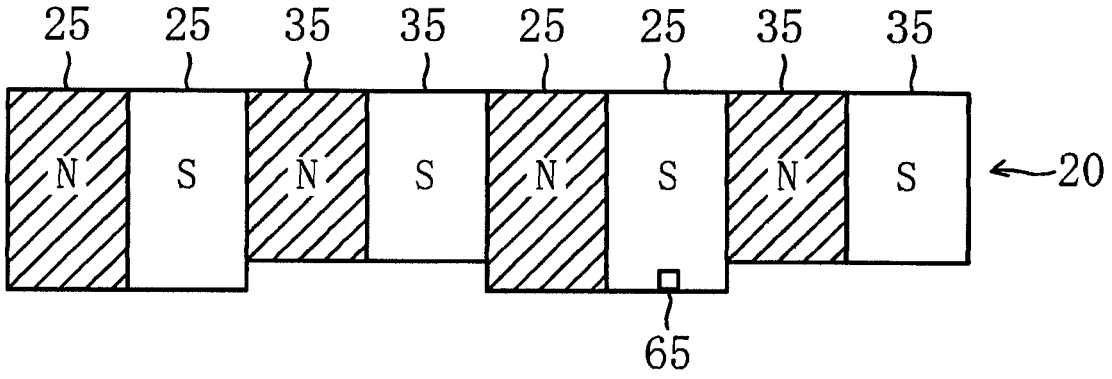
FIG. 28 is a view illustrating that the convertible magnets are detected using the magnetic sensor.
Figure 29:
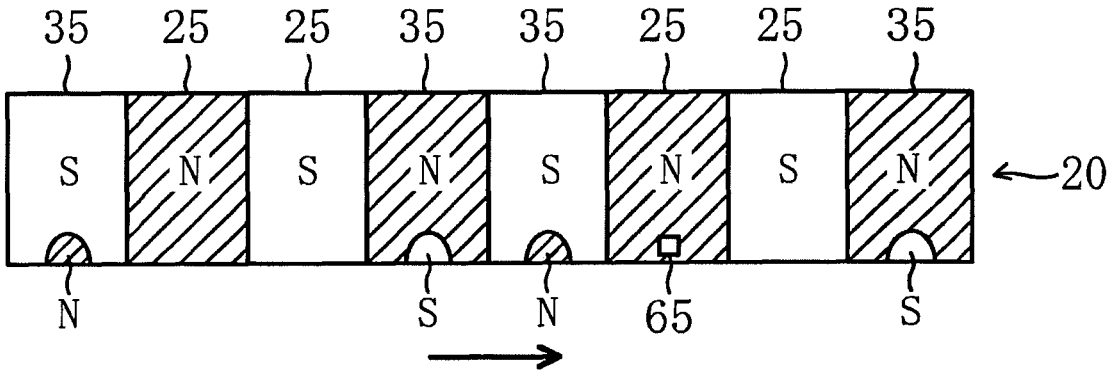
FIG. 29 is a view illustrating a disposition of the magnetic sensor for the convertible magnets and the fixed magnets.
Figure 30:
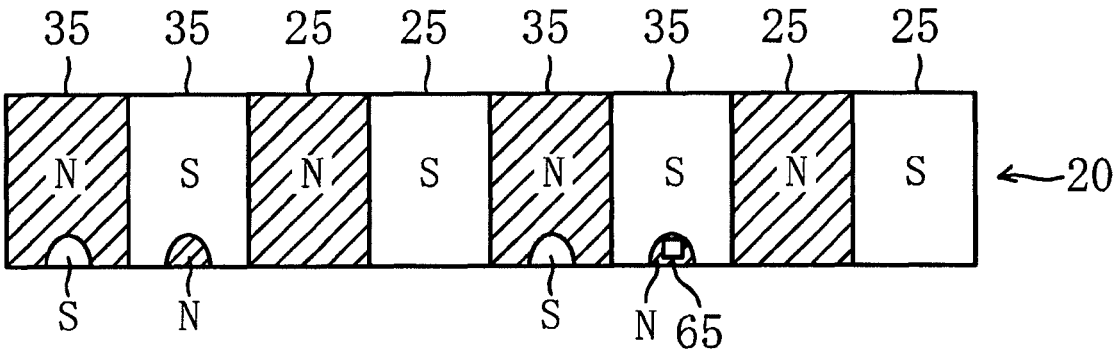
FIG. 30 is a view illustrating that a different magnetic pole part of the fixed magnet is detected using the magnetic sensor.

FIG. 25 is a view illustrating a position relationship between the convertible magnet and the tee when a phase of applying a current is not converted, FIG. 26 is a view illustrating a position relationship between the convertible magnet and the tee when the phase of applying a current is converted, FIG. 27 is a view illustrating a disposition of a magnetic sensor for the convertible magnets and the fixed magnets, FIG. 28 is a view illustrating that the convertible magnets are detected using the magnetic sensor, FIG. 29 is a view illustrating a disposition of the magnetic sensor for the convertible magnets and the fixed magnets, and FIG. 30 is a view illustrating that a different magnetic pole part of the fixed magnet is detected using the magnetic sensor.

In detail, as shown in FIG. 25, when the rotation of the outer rotor 20 is quick compared with a magnetization current pulse time when magnetizing only using the U phase tee, since the convertible magnet 25 deviates from the tee 61 that performs magnetization, it may be impossible to adequately perform magnetization. Accordingly, although it may be considered to decrease a rotation speed of the outer rotor 20, undesirably, fluctuation in positional precision degree or magnetization increases due to a decrease of the inertia moment effect.

Accordingly, in the second embodiment of the disclosure, as shown in FIG. 26, the tee 61 that performs magnetization is converted from a U phase into a V phase according to a rotation movement amount of the outer rotor 20. Accordingly, it is possible to adequately convert the convertible magnet 25 to have an opposite magnetic pole.

As described above, when magnetization of the outer rotor 20 having the convertible magnets 25 is performed, in applying of the magnetization currents, adequate magnetization is available by changing a current applying phase of the tee 61 magnetized according to a movement of the outer rotor 20, at the coil 63. Here, the current applying phase during magnetization is performed by adding a magnet movement amount to an initial phase of the outer rotor 20 as an initial value.

Here, the initial value of the initial phase refers to a current phase when magnetization currents are applied. For example, an initial value of magnetization in a U phase is 0°+an offset amount, an initial value of magnetization in a W phase is −120°+an offset amount, and an initial value of magnetization in a V phase is 120°+an offset amount. Also, an offset amount refers to a parameter that adjusts a current level to be a current peak when the convertible magnet 25 arrives at a destination.

However, to convert a magnetic pole number of the outer rotor 20 by reversing magnetic poles of the convertible magnets 25, it is necessary to determine positions of the convertible magnets 25 and the fixed magnets 35. Accordingly, in the second embodiment of the disclosure, a position sensor or a magnetic sensor 65 is used as a magnet determiner.

As shown in FIG. 27, in the outer rotor 20, a group of two adjacent convertible magnets 25 and a group of two adjacent fixed magnets 35 are alternately arranged. A bottom end of the convertible magnet 25 protrudes and extends more downward than a bottom end of the fixed magnet 35. That is, the convertible magnet 25 is longer than the fixed magnet 35.

Also, the magnetic sensor 65 is disposed opposite to a part of the convertible magnet 25 longer than the fixed magnet 35. The magnetic sensor 65 may be fixed, for example, to the stator 60 or another structure.

At a position of the outer rotor 20 shown in FIG. 27, the magnetic sensor 65 is positioned below the fixed magnet 35. Here, when the outer rotor 20 rotates, as shown in FIG. 28, the magnetic sensor 65 faces the convertible magnet 25 and receives a signal different from that of the state shown in FIG. 27. Based on the different signal, the convertible magnets 25 and the fixed magnets 35 may be determined by the magnetic sensor 65. Also, the controller 15 controls rotations of the outer rotor 20 and the inner rotor 30 based on the positions of the fixed magnets 35.

Also, even when the magnetic sensor 65 may be disposed on any one of an outside and an inside rather than the outer rotor 20 and disposed on a cross section, it is possible to obtain the same function. Also, even in a configuration having the convertible magnets 25 at the inner rotor 30, it is possible to determine magnets by identically arranging the magnetic sensor 65.

Also, even though the determination is available using the magnetic sensor 65 by changing lengths of the convertible magnets 25 and the fixed magnets 35 in an example shown in FIG. 27, the disclosure is not limited thereto. For example, magnetization may be performed to temporarily demagnetize the convertible magnets 25 and positions of the convertible magnets 25 may be determined based on a change thereof and may return to an original state.

Also, it is possible to determine a magnet by changing a magnetization state such as a magnetization amount, a magnetization shape and the like of a part facing the magnetic sensor 65. In detail, as shown in FIG. 29, a different pole may be formed at part of the fixed magnet 35 and the magnetic sensor 65 may be disposed to face the different pole. Here, when the outer rotor 20 rotates, since the magnetic sensor 65 faces the different pole of the fixed magnet 35 as shown in FIG. 30, a position of the fixed magnet 35 may be specified and the convertible magnet 25 and the fixed magnet 35 may be determined by the magnetic sensor 65.

Also, although the outer magnets 24 are formed of the convertible magnets 25 and the fixed magnets 35, all the outer magnets 24 may be formed of the convertible magnets 25. In this case, it is possible to convert a magnetic pole number by reversing only magnetic poles of a random half of the convertible magnets 25. According to the above, magnetization may be converted without distinguishing the convertible magnets 25 and the fixed magnets 35 from each other.

Figure 31:
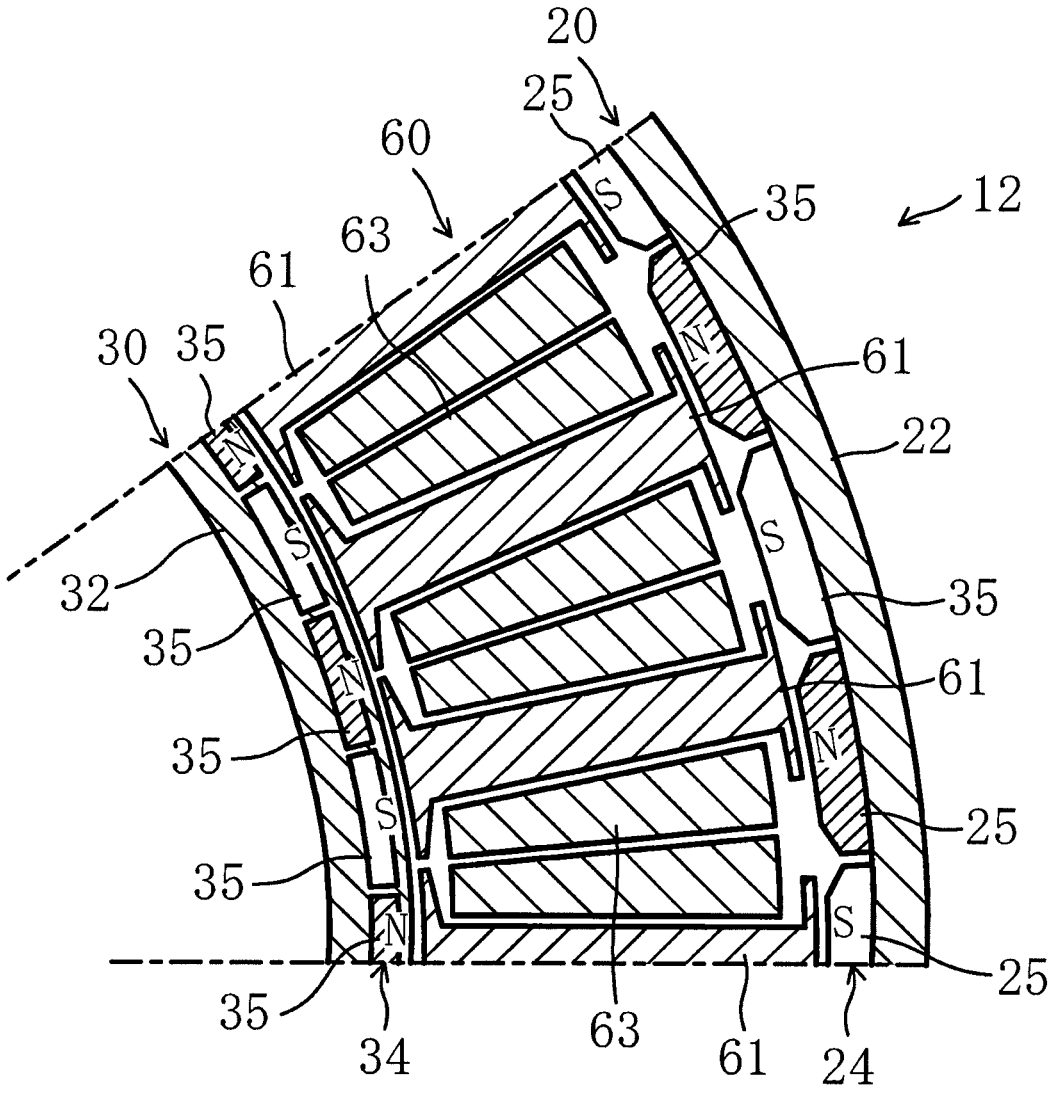
FIG. 31 is a top cross-sectional view illustrating a configuration of the motor according to a third embodiment of the disclosure.

FIG. 31 is a top cross-sectional view illustrating a configuration of the motor according to a third embodiment of the disclosure.

In FIG. 31, the inner rotor 30 is an embedded SPM type rotor in which thirty two inner magnets 34 are arranged to allow S poles and N poles to be alternately arranged in a circumferential direction and are embedded in the inner peripheral wall 32. All of the inner magnets 34 are formed of the fixed magnets 35.

The outer rotor 20 is an SPM type rotor, and thirty two outer magnets 24 are arranged to allow S poles and N poles to be alternately arranged in the circumferential direction and fixed to the inner surface of the rotor yoke 22. Also, although the outer magnets 24 include the convertible magnets 25 and the fixed magnets 35, since arrangements thereof are identical to those in the second embodiment, a description thereof will be omitted.

Figure 32:
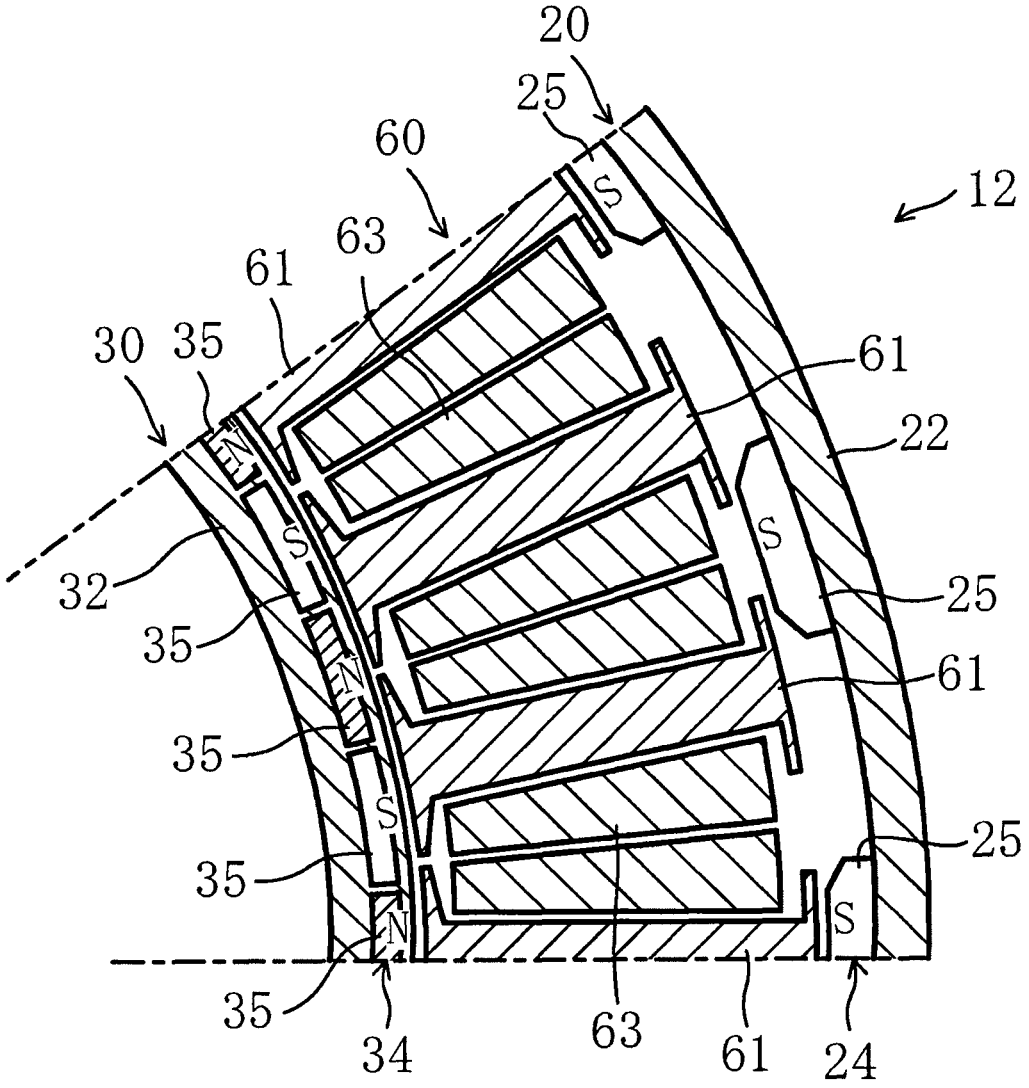
FIG. 32 is a top cross-sectional view illustrating a configuration of the motor according to a fourth embodiment of the disclosure.

FIG. 32 is a top cross-sectional view illustrating a configuration of the motor according to a fourth embodiment of the disclosure.

In FIG. 32, the inner rotor 30 is an embedded SPM type rotor in which thirty two inner magnets 34 are arranged to allow S poles and N poles to be alternately arranged in a circumferential direction and are embedded in the inner peripheral wall 32. All of the inner magnets 34 are formed of the fixed magnets 35.

The outer rotor 20 is a consequent rotor in which sixteen outer magnets 24 are arranged to align S poles at intervals in the circumferential direction and are fixed to the inner surface of the rotor yoke 22. All of the outer magnets 24 are formed of the convertible magnets 25, and a magnetic pole number of the outer rotor 20 may be converted between 16 and 32 by reversing magnetic poles of the convertible magnets 25. Also, since the reversal of the magnetic poles of the convertible magnets 25 is identical to that in the first embodiment, a description thereof will be omitted.

Figure 33:
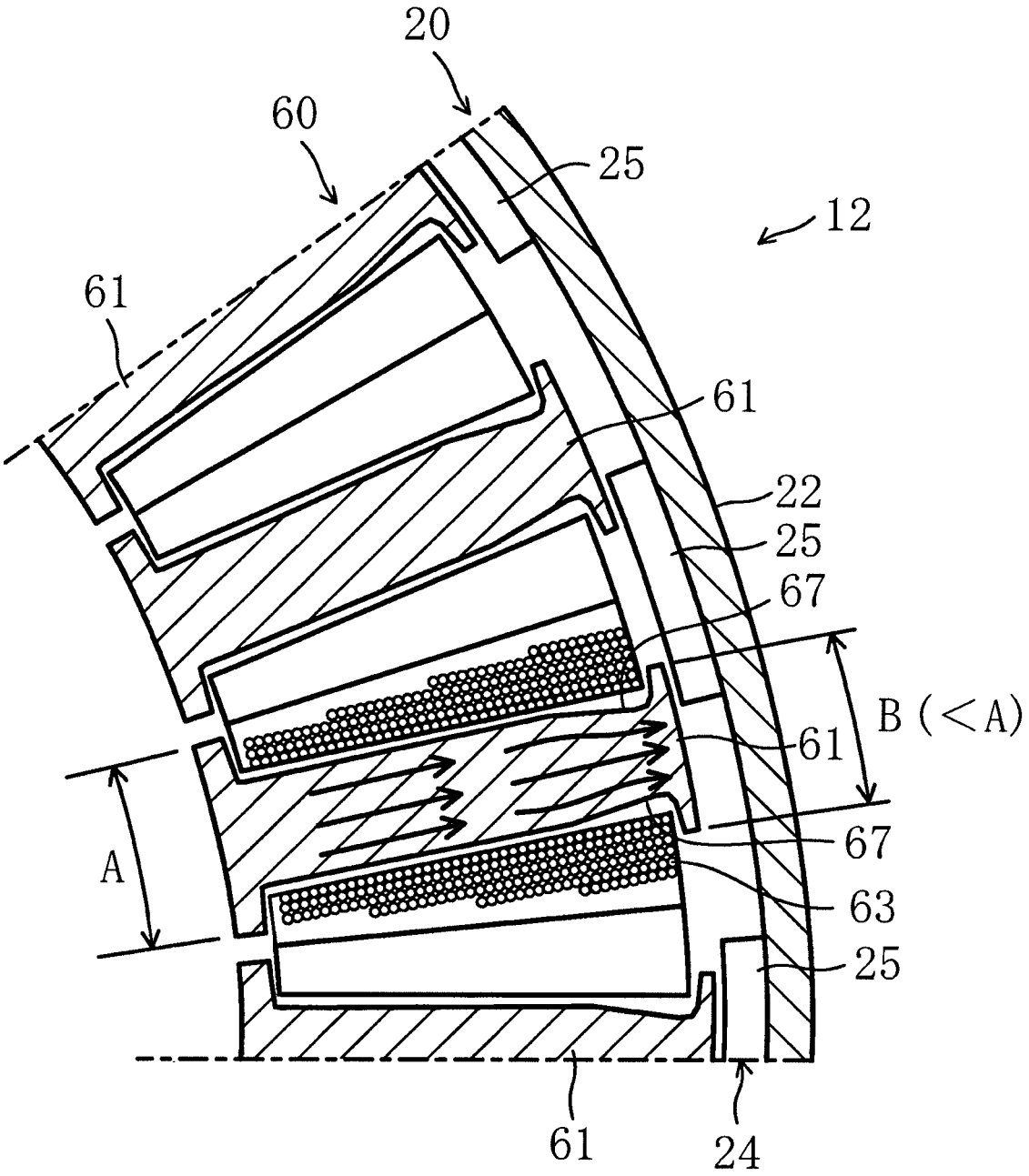
FIG. 33 is a top cross-sectional view illustrating a configuration of the motor according to a fifth embodiment of the disclosure.
Figure 34:
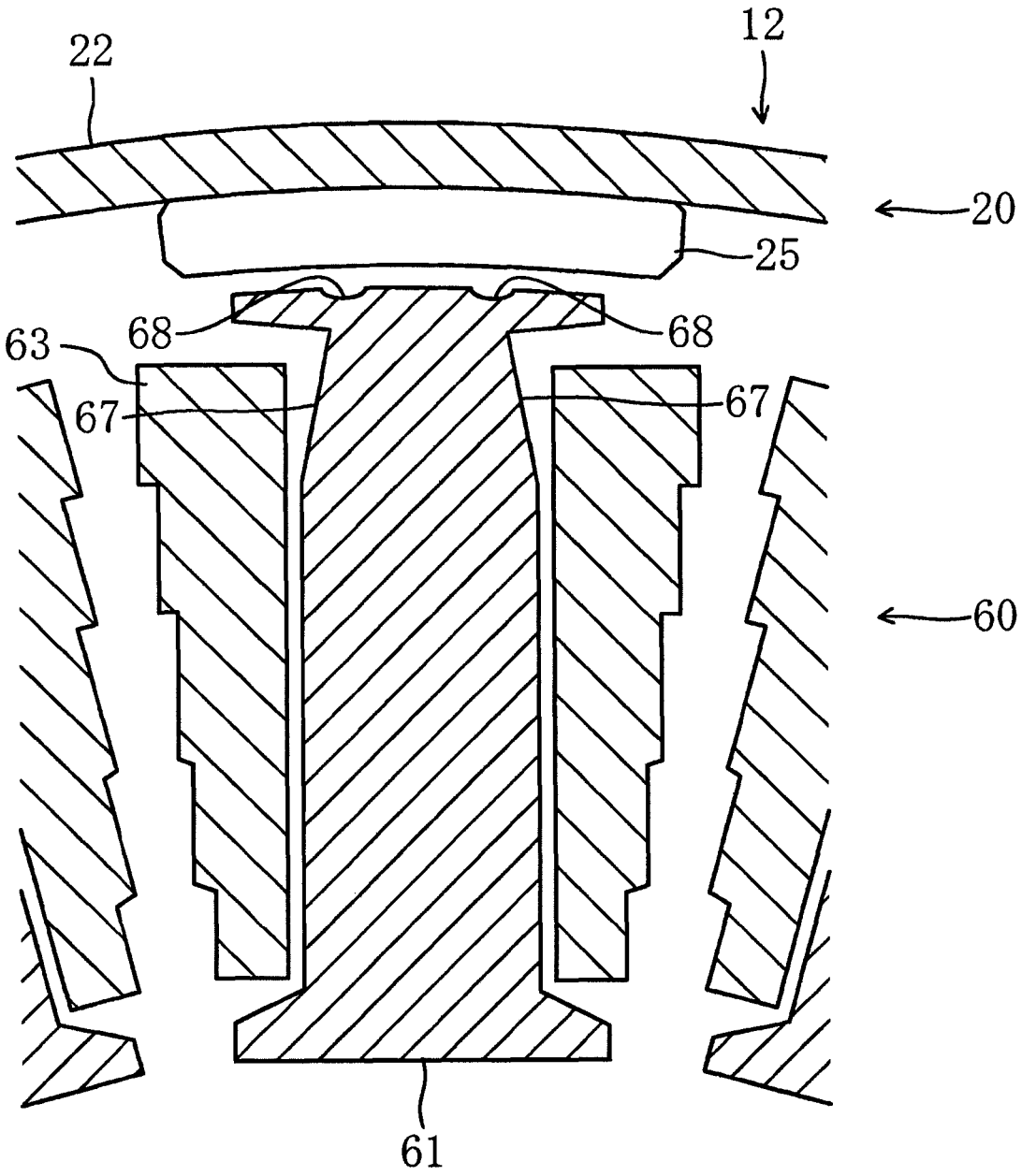
FIG. 34 is a top cross-sectional view illustrating a state in which a groove is formed at a front end of the tee.

FIG. 33 is a top cross-sectional view illustrating a configuration of the motor according to a fifth embodiment of the disclosure, and FIG. 34 is a top cross-sectional view illustrating a state in which a groove is formed at a front end of the tee.

In FIG. 33, a narrow width portion 67 is installed at the tee 61 to allow a width of a part of the tee 61 toward the outer rotor 20 having the convertible magnet 25 to be narrower than a width of a part of the tee 61 toward the inner rotor 30. The narrow width portion 67 is formed to allow a width of the tee 61 to be narrower toward the outer rotor 20.

As described above, the density of magnetic flux may be increased by installing the narrow width portion 67 at the tee 61 and reducing the width of the part of tee 61 toward the outer rotor 20. That is, magnetic flux of magnetization generated by currents applied to the coil 63 may intensively flow toward the convertible magnet 25 and the magnetic pole of the convertible magnet 25 may be stably reversed using less currents. Also, a shape of the narrow width portion 67 is not particularly limited, and for example, may be a step shape in which a width of a part of the tee 61 toward the outer rotor 20 is narrow.

Also, the coil 63 is wound on the tee 61 to allow times of being wound on a part toward the outer rotor 20 having the convertible magnet 25 to be more than times of being wound on a part toward the inner rotor 30. Due thereto, it is possible to allow magnetic flux toward at the convertible magnet 25 to be more intensive than that of opposite side thereof.

Also, an angle width of the front end of the tee 61 is formed to allow an angle width B toward the outer rotor 20 having the convertible magnet 25 to be smaller than an angle width A toward the inner rotor 30 (B<A). Due thereto, it is possible to allow magnetic flux toward the convertible magnet 25 to be more intensive than that of opposite side thereof.

Also, even when an angle width of the front end of the tee 61 is identical throughout parts toward the outer rotor 20 and the inner rotor 30, the same function may be obtained by forming a cross section of the front end of the tee 61 to allow a part toward the outer rotor 20 having the convertible magnet 25 to be smaller than a part toward the inner rotor 30.

In detail, as shown in FIG. 34, a groove 68 axially extended is formed in a surface of the front end of the tee 61 facing the outer rotor 20. Two grooves 68 are formed at an interval in a circumferential direction. As described above, it is possible to allow the magnetic flux at the convertible magnet 25 to be more intensive than that of opposite side thereof by forming the front end of the tee 61 to allow an air gap area except the grooves 68 substantially facing the outer magnet 24 to be smaller than an air gap area toward the inner rotor 30.

Other embodiments of the disclosure are within the scope of the disclosure and may have following configurations. For example, although a configuration in which a magnetic pole of the convertible magnet 25 is reversed by supplying a magnetization current to the coil 63 using the coil 63 of the stator 60 as a magnetic pole number converter has been described above, in other embodiments of the disclosure, for example, separately from the coil 63 of the stator 60, a magnetization coil for reversing the magnetic pole by supplying a magnetization current to the convertible magnet 25 may be installed.

Also, although an inverter for a motor is used as the controller 15 that supplies a magnetization current to the coil 63, in other embodiments of the disclosure, for example, a separate exclusive controller may be used.

Also, a principle in which the outer rotor 20 and the inner rotor 30 are driven to rotate in the synchronous rotation mode or the contrary rotation mode has been described based on a state of the six steps shown in FIGS. 10A to 10F and 11A to 11F, in other embodiments of the disclosure, it is not limited thereto. For example, it is possible to arbitrarily select one of a square wave current applying method, a sine wave driving, vector controlling and the like.

Also, although a configuration in which a magnetic pole number of the stator 60 is 24, a magnetic pole number of the inner rotor 30 is 32, and a magnetic pole number of the outer rotor 20 is convertible between 32 and 16 has been described, in other embodiments of the disclosure, it is possible to configure the same rotation mode or a rotation mode having a different rotation number using an additional combination. That is, when the magnetic pole number of the inner rotor 30 is 2N (here, N is an even number), magnetic poles of the outer rotor 20 may be converted between 2N and N.

Also, although a configuration in which the inner rotor 30 at a high speed rotation side is connected to the spin-drying tub 11 and the outer rotor 20 at a low speed rotation side is connected to the pulsator 13 has been described, in other embodiments of the disclosure, merchantability such as spin-drying performance or washing performance may be improved by connecting the inner rotor 30 to the spin-drying tub 11 and connecting the outer rotor 20 to a rotating shaft having another function.

Also, although a magnetic pole number of the outer rotor 20 is convertible by installing the convertible magnets 25 at the outer rotor 20, in other embodiments of the disclosure, a magnetic pole number of the inner rotor 30 may be convertible by installing the convertible magnets 25 at the inner rotor 30. For example, when the magnetic pole number of the inner rotor 30 is 2N (here, N is an even number), magnetic poles of the inner rotor 30 may be converted between 2N and N.

Also, in other embodiments of the disclosure, even in the motor 12 having one of the outer rotor 20 and the inner rotor 30, a magnetic pole number of the one rotor may be convertible by installing the convertible magnets 25 at the one rotor. For example, in the case of the motor 12 having only the inner rotor 30, magnetic poles of the inner rotor 30 may be converted between 2N and N. On the other hand, in the case of the motor 12 having only the outer rotor 20, magnetic poles of the outer rotor 20 may be converted between 2N and N.

As is apparent from the above description, a washing machine in accordance with one or more embodiments of the disclosure may rotate a first rotor and a second rotor in a plurality of rotation modes and may independently drive the two rotors using one inverter in a simple configuration without supplying a composite current, which provides high practicality and has high industrial applicability.

In addition, the disclosure is not limited to the above-described embodiments and the configurations disclosed in the embodiments may be combined and may be variously modified without departing from the scope thereof.

Although embodiments of the disclosure have been shown and described, it would be appreciated by those skilled in the art that changes may be made to these embodiments without departing from the principles and spirit of the disclosure, the scope of which is defined in the claims and their equivalents.

What is claimed is:

1. A washing machine, comprising:

a washing tub;

a spin-drying tub rotatably installed in the washing tub;

a pulsator rotatably installed in the spin-drying tub;

a motor configured to rotate the spin-drying tub and the pulsator, the motor including:

an annular stator including a plurality of teeth, and wound with a coil and each of the plurality of teeth arranged along a radial direction of the annular stator, a first rotor rotatable independently from the annular stator and positioned at a first end of a respective tooth among the plurality of teeth of the annular stator, and a second rotor rotatable independently from the annular stator and positioned at a second end of the respective tooth among the plurality of teeth of the annular stator; and at least one processor configured to control a conversion operation of the plurality of teeth of the annular stator to magnetize at least one of a plurality of convertible magnets, wherein one of the first rotor and the second rotor is connected to the spin-drying tub, and another of the first rotor and the second rotor is connected to the pulsator, wherein the at least one processor is configured to control the conversion operation of the plurality of teeth to magnetize all of the plurality of convertible magnets with a random magnetic flux amount.

2. The washing machine of claim 1, wherein the at least one processor is connected to an inverter, the at least one processor being configured to drive the first rotor and the second rotor in a plurality of rotation modes by reversing magnetic poles of at least one of the first rotor and the second rotor.

3. The washing machine of claim 2, wherein the plurality of teeth are configured to convert a magnetic pole number by reversing magnetic poles of at least one of the first rotor and the second rotor, wherein the at least one processor is configured to drive the first rotor and the second rotor in the plurality of rotation modes by controlling the conversion operation of the plurality of teeth.

4. The washing machine of claim 3, wherein one of the first rotor and the second rotor includes the plurality of convertible magnets with magnetic poles that are reversible based on the conversion operation of the plurality of teeth, and the other of the first rotor and the second rotor includes a plurality of fixed magnets with magnetic poles that are not reversible based on the conversion operation of the plurality of teeth.

5. The washing machine of claim 4, wherein the at least one processor is configured to control the conversion operation of the plurality of teeth to reverse at least one of the magnetic poles of the plurality of convertible magnets.

6. The washing machine of claim 3, wherein the plurality of teeth has a common magnetic path with respect to the first rotor and the second rotor and is configured to convert a magnetic pole number by reversing magnetic poles of at least one of the first rotor and the second rotor when magnetization currents are applied to the coil wound on the magnetic path.

7. The washing machine of claim 3, wherein the first rotor includes a plurality of first magnets which include the plurality of convertible magnets, the second rotor includes a plurality of second magnets, and among the teeth magnetized when magnetization currents are supplied to the coil wound on the plurality of teeth, a magnetic resistance that passes through the plurality of first magnets including the plurality of convertible magnets is greater than a magnetic resistance near an air gap which does not pass through the plurality of second magnets of the second rotor.

8. The washing machine of claim 3, wherein the first rotor includes a plurality of first magnets which include the plurality of convertible magnets, the second rotor includes a plurality of second magnets, and among the teeth magnetized when magnetization currents are supplied to the coil wound on the teeth, a magnetic resistance that passes through the plurality of second magnets of the second rotor is greater than a magnetic resistance near an air gap which does not pass through the plurality of first magnets including the plurality of convertible magnets of the first rotor.

9. The washing machine of claim 3, wherein the first rotor is an inner rotor disposed inside the annular stator with respect to the radial direction of the annular stator, and the second rotor is an outer rotor disposed outside the annular stator with respect to the radial direction of the annular stator.

10. The washing machine of claim 9, wherein the outer rotor comprises a plurality of convertible magnets with magnetic poles converted based on the conversion operation of the plurality of teeth, and the inner rotor comprises a plurality of fixed magnets having polarities that are not converted based on the conversion operation of the plurality of teeth.

11. The washing machine of claim 2, wherein the plurality of rotation modes comprise a first rotation mode of driving the first rotor and the second rotor in opposite directions and a second rotation mode of driving the first rotor and the second rotor in a same direction.

12. The washing machine of claim 11, wherein the at least one processor is configured to drive the spin-drying tub and the pulsator in the first rotation mode during a washing operation.

13. The washing machine of claim 11, wherein the at least one processor is configured to drive the spin-drying tub and the pulsator in the second rotation mode during a spin-drying operation.

14. The washing machine of claim 11, wherein the at least one processor is configured to drive the first rotor and the second rotor in at least two rotation modes each having a different speed.

15. The washing machine of claim 11, wherein the at least one processor is configured to drive the first rotor and the second rotor in the second rotation mode during a high speed rotation operation in which a number of rotations of the first rotor and the second rotor are greater than a predetermined number of rotations.

16. The washing machine of claim 1, wherein the first rotor and the second rotor are formed of two or more types of magnets having different coercive forces.

17. The washing machine of claim 1, wherein the plurality of teeth are arranged at intervals in a circumferential direction and extend along a diametrical direction.

18. A washing machine, comprising:

a washing tub;

a spin-drying tub rotatably installed in the washing tub;

a pulsator rotatably installed in the spin-drying tub; and a motor configured to rotate the spin-drying tub and the pulsator, the motor including:

a stator including a plurality of teeth, and wound with a coil and each of the plurality of teeth arranged along a radial direction of the stator, an inner rotor, disposed inside of the stator with respect to the radial direction of the stator at a first end of a respective tooth among the plurality of teeth of the stator, the inner rotor being connected to the spin-drying tub and rotatable independently from the stator, and configured to be driven in a plurality of rotation modes, and an outer rotor, disposed outside of the stator with respect to the radial direction of the stator at a second end of the respective tooth among the plurality of teeth of the stator, the outer rotor being connected to the pulsator and rotatable independently from the stator, and configured to be driven in the plurality of rotation modes;

at least one processor configured to:

control a conversion operation of the plurality of teeth to magnetize a plurality of convertible magnets, and control the conversion operation of the plurality of teeth to magnetize all of the plurality of convertible magnets with a random magnetic flux amount.

19. The washing machine of claim 18, wherein the plurality of rotation modes include:

a synchronous rotation mode in which the inner rotor and the outer rotor rotate in a same direction at a same speed, and a contrary rotation mode in which the inner rotor and the outer rotor rotate in different directions at different speeds.

20. The washing machine of claim 18, wherein the at least one processor is connected to an inverter, the at least one processor being configured to drive the inner rotor and the outer rotor in a plurality of rotation modes by reversing magnetic poles of at least one of the inner rotor and the outer rotor.

* * * * *